United States Patent [19]

Kishi et al.

[11] Patent Number: 4,746,264

[45] Date of Patent: May 24, 1988

[54] EARTH-WORKING MACHINE

[75] Inventors: Mitsuhiro Kishi; Yokichi Nagasawa, both of Ashikaga

[73] Assignee: Kabushiki Kaisha Hikoma Seisakusho, Tochigi, Japan

[21] Appl. No.: 920,924

[22] Filed: Oct. 16, 1986

Related U.S. Application Data

[63] Continuation of Ser. No. 817,151, Jan. 2, 1986, abandoned, which is a continuation of Ser. No. 570,535, Jan. 13, 1984, abandoned.

[30] Foreign Application Priority Data

| | | | |
|---|---|---|---|
| Feb. 12, 1983 | [JP] | Japan | 58-22350 |
| Mar. 4, 1983 | [JP] | Japan | 58-35440 |
| Mar. 4, 1983 | [JP] | Japan | 58-35441 |
| Sep. 7, 1983 | [JP] | Japan | 58-164736 |
| Nov. 18, 1983 | [JP] | Japan | 58-217573 |

[51] Int. Cl.[4] ..... E02F 5/02

[52] U.S. Cl. ..... 414/687; 37/103; 73/518; 318/67; 324/208; 414/694

[58] Field of Search ..... 414/685, 687, 694; 901/9; 37/103, 117.5; 73/518, 514, 862.36; 324/208, 226; 318/67, 68

[56] References Cited

U.S. PATENT DOCUMENTS

| | | | |
|---|---|---|---|
| 4,053,826 | 10/1977 | Wasawa et al. | 324/208 |
| 4,150,314 | 4/1979 | Zabler et al. | 324/208 X |
| 4,283,679 | 8/1981 | Ito et al. | 324/208 X |
| 4,596,508 | 6/1986 | Kishi et al. | 414/694 X |

*Primary Examiner*—Robert J. Spar
*Assistant Examiner*—P. McCoy Smith
*Attorney, Agent, or Firm*—Koda and Androlia

[57] ABSTRACT

An earth-working machine includes a first internal gear fixedly mounted on a mobile chassis, a turntable coaxially rotatably mounted on the first internal gear, a carriage rotatably mounted on the turntable in eccentric relation thereto and having a second internal gear, an earth-working mechanism mounted on the carriage, a first hydraulic motor mounted on the turntable and having a first pinion held in driving mesh with the first internal gear for rotating the turntable about its own axis, a second hydraulic motor mounted on the turntable and having a second pinion held in driving mesh with the second internal gear for rotating the carriage about its own axis, and hydraulic driving devices for actuating the first and second hydraulic motors independently or in synchronism. The hydraulic driving devices may be controlled by an electric control system supplied with signals from angle detectors such as rotary encoders for detecting angular displacements of the turntable and the carriage.

9 Claims, 14 Drawing Sheets

+V
SOL
DRIVER
RS FLIP-FLOP
COUNT MEMORY
COINCIDENCE CKT.
ONE-SHOT MULTIVIBRATOR
COUNTER
COMPARATOR AND COINCIDENCE CKT.
(B>A)
(A=B)
COUNT SETTING CKT.
GATE
FREQUENCY DIVIDER
BUFFER
CHATTERING PREVENTION CKT.
PULSE GEN

EARTH-WORKING MACHINE

This is a continuation of application Ser. No. 817,151, filed Jan. 2, 1986, now abandoned, which was a continuation of application Ser. No. 570,535, filed Jan. 13, 1984, now abandoned.

BACKGROUND OF THE INVENTION

The present invention relates to an earth-working machine such as an excavator for digging ditches in road construction, the earth-working machine having a turntable and a carriage which are controllably angularly movable independently on a self-propelled mobile chassis for enabling an excavating mechanism on the carriage to turn in various angular ranges for avoiding interference with surrounding traffic and/or objects and providing wide working areas for the excavating mechanism.

Conventional earth-working machines or excavators include an excavating mechanism composed of a boom or bucket arm having a bucket on its distal end for trenching a ditch in a road. In operation, the material scooped by the bucket is transferred back by turning the boom around the machine. Since the boom is angularly moved through an semicircular angular range, the boom and the bucket as they move project laterally of the machine, resulting in the danger of interfering with surrounding traffic and/or objects. Therefore, a large working radius or range clear of any obstructions should be reserved around the machine for allowing safe swinging movement of the boom. This requirement however is difficult or eve impossible to meet in situations where only relatively small or limited spaces are available for the machine.

To cope with such a difficulty, there has been proposed an excavator having a turntable rotatably mounted on a mobile chassis and a carriage rotatably mounted on the turntable and supporting an excavating mechanism, the turntable and the carriage having shafts positioned out of coaxial relation. With this arrangement, the bucket on the boom is allowed to move over the chassis without projecting laterally thereof when the turntable and the carriage are turned about their shafts. Therefore, unwanted interference with traffic or objects is prevented around the machine, and the excavator can be placed in relatively small spaces for road construction or other earth-moving applications. The proposed excavator however still suffers the drawbacks in that the turntable and the carriage have to be rotated in predetermined directions in synchronism with each other in order to cause the bucket to pass over the chassis, and a relatively complex mechanism is necessary for turning the turntable and the carriage in such a manner. The conventional turning mechanism comprises a mechanical driving assembly composed of gears for actuating the turntable and the carriage synchronously with each other. However, such mechanism allows stresses to be localized in certain parts, which tend to be damaged or otherwise fail, and also undergoes increased friction resulting in a large power loss and poor efficiency.

SUMMARY OF THE INVENTION

It is an object of the present invention to provide an earth-working machine having a turntable and a carriage mounted on the turntable and supporting an excavating mechanism, the turntable and the carriage being rotatable by respective hydraulic motors and controllable by an electric control system to rotate synchronously at a predetermined angular displacement ratio.

Another object of the present invention is to provide an earth-working machine having a turntable and a carriage supporting thereon an excavating mechanism, and an electric control system for turning the carriage with respect to the turntable from a selected angular position and stopping in such a selected angular position.

Still another object of the present invention is to provide an earth-working machine including a turntable and a carriage rotatably mounted on the turntable and supporting thereon an excavating mechanism, and an electric control system capable of stopping the turntable at any desired angular position with respect to a chassis of the machine and also stopping the carriage at any desired angular position with respect to the turntable, thereby widening the range of operation of the earth-working machine.

A still further object of the present invention is to provide an earth-working machine having a turntable and a carriage supporting an excavating mechanism, the turntable and the carriage being drivable by hydraulic motors controlled by a hydraulic driving system for synchronized and individual rotation of the turntable and the carriage.

A still further object of the present invention is to provide an earth-working machine having a turntable and a carriage supporting an excavating mechanism, the turntable and the carriage being drivable by hydraulic motors operated by a hydraulic driving system under the control of an electric control system for rotating the turntable and the carriage individually and synchronously in a manual mode or synchronously in an automatic mode.

According to the present invention, there is provided an earth-working machine including a first internal gear fixedly mounted on a mobile chassis, a turntable coaxially rotatably mounted on the first internal gear, a carriage rotatably mounted on the turntable in eccentric relation thereto and having a second internal gear, an earth-working mechanism mounted on the carriage, a first hydraulic motor mounted on the turntable and having a first pinion held in driving mesh with the first internal gear for rotating the turntable about its own axis, a second hydraulic motor mounted on the turntable and having a second pinion held in driving mesh with the second internal gear for rotating the carriage about its own axis, and hydraulic driving means for actuating the first and second hydraulic motors. The hydraulic driving means may be controlled by an electric control system supplied with signals from angle detectors such as rotary encoders for detecting angular displacements of the turntable and the carriage. The turntable and the carriage may be rotated independently or synchronously at a certain angular displacement ratio.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
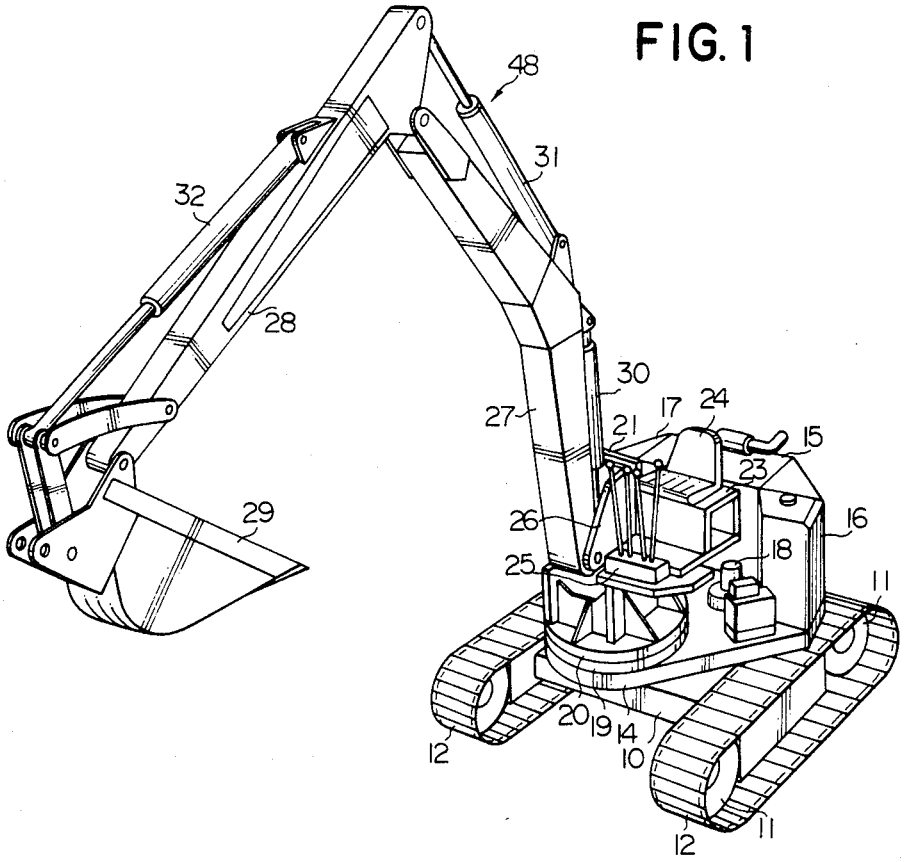
FIG. 1 is a perspective view of an excavator according to the present invention.

The present invention is particularly useful when embodied in an earth-working machine such as an excavator or trenching machine as shown in the drawings. Like or corresponding parts are denoted by like or corresponding reference characters throughout the views.

Figure 2:
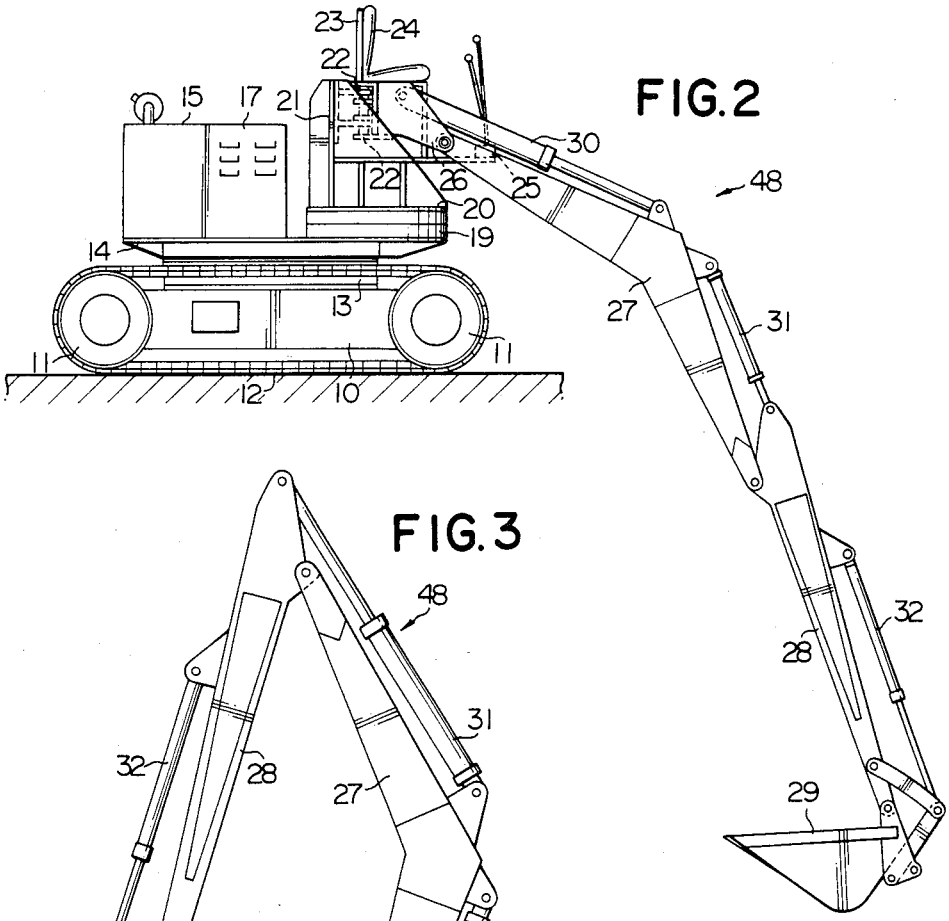
FIG. 2 is a side elevational view of the excavator shown in FIG. 1.
Figure 3:
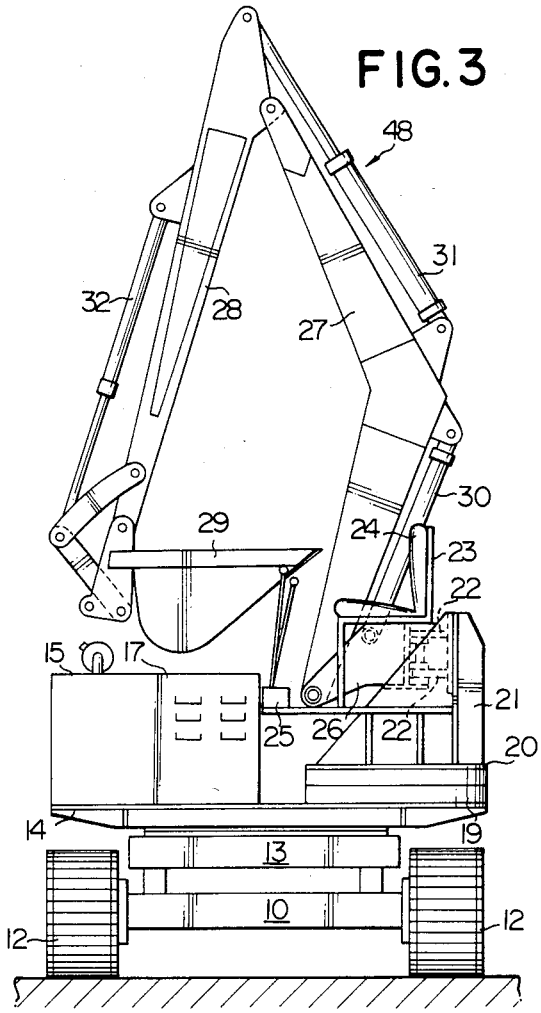
FIG. 3 is a front elevational view of the excavator of FIG. 1.
Figure 4:
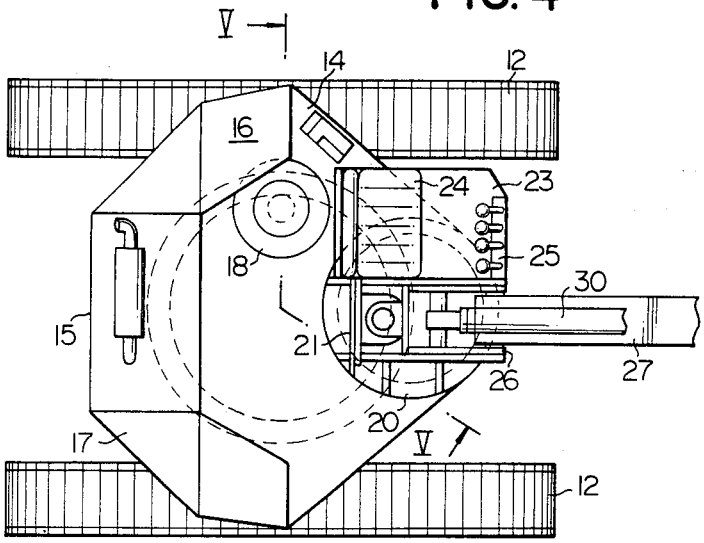
FIG. 4 is a plan view of the excavator of FIG. 1.

As shown in FIGS. 1 through 5, the excavator is of the self-propelled type having a flat mobile chassis 10 supporting four wheels 11 with an endless track 12 trained around each pair of wheels 11. The mobile chassis 10 includes a central support base 13 (FIGS. 2, 3 and 5) mounted thereon and having an upper annular flange on which a horizontal turntable 14 of an octagonal configuration is rotatably mounted. As better shown in FIG. 4, the turntable 14 supports thereon an engine 15, a fuel tank 16, and a hydraulic oil tank 17 arranged along a rear edge of the turntable 14. A first hydraulic motor 18 is also mounted on the turntable 14 adjacent to the fuel tank 16 and has a drive shaft 36 (FIG. 5) directed downwardly of the turntable 14. As illustrated in FIGS. 2 and 3, an annular horizontal holder base 19 is fixedly mounted on the turntable 14 at a front edge thereof. The annular holder base 19 has an axis held in horizontally eccentric and parallel relation to the axis of the support base 13 and hence the turntable 14. A circular carriage 20 is rotatably mounted coaxially on the holder base 19.

Figure 5:
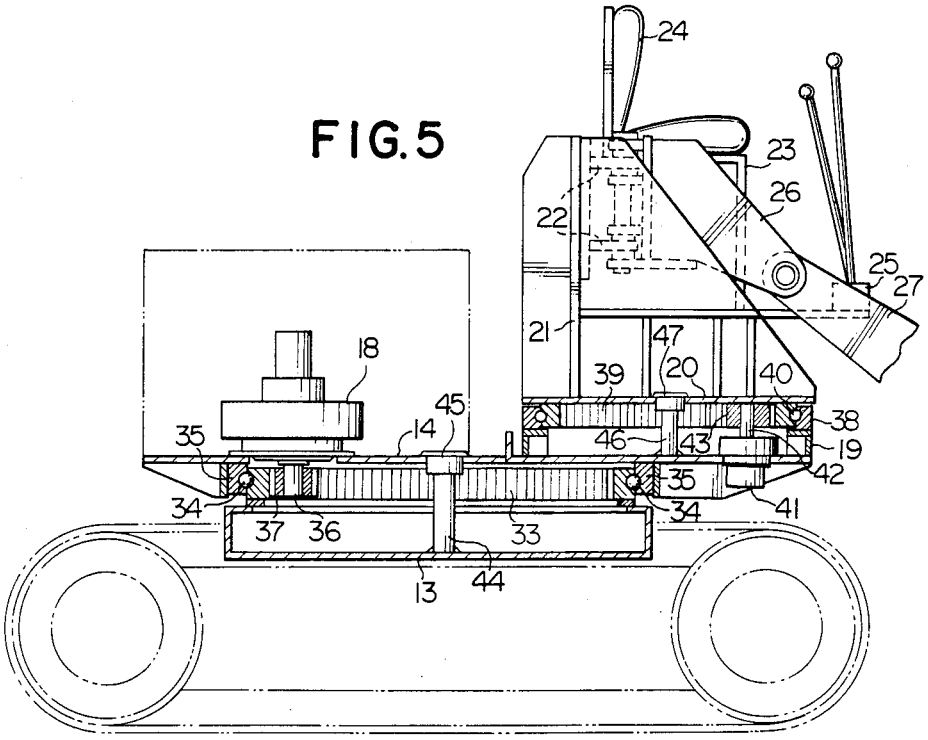
FIG. 5 is an enlarged cross-sectional view taken along line V—V of FIG. 4.

As shown in FIGS. 3 and 5, the carriage 20 includes a vertical support 21 to which a pair of vertically spaced legs 22 is secured. A bracket 26 is pivotably mounted on the legs 22 and supports thereon a bent boom 27 which is vertically angularly movable about a pivot on the bracket 26. The boom 27 supports on its distal end a bucket arm 28 having a bucket 29 pivotably mounted on a distal end of the bucket arm 28. Hydraulic cylinders 30, 31, 32 are coupled respectively between the bracket 26 and a central portion of the boom 27, between a central portion of the boom 27 and an end of the bucket arm 28, and between the bucket arm 28 and the bucket 29. The boom 27, the bucket arm 28, the bucket 29, and the hydraulic cylinders 30, 31, 32 jointly constitute an excavating mechanism 48. The bracket 26 also supports a seat base 23 on which there are mounted an operator seat 24 and a hydraulic control box 25 having a plurality of control levers.

Figure 6:
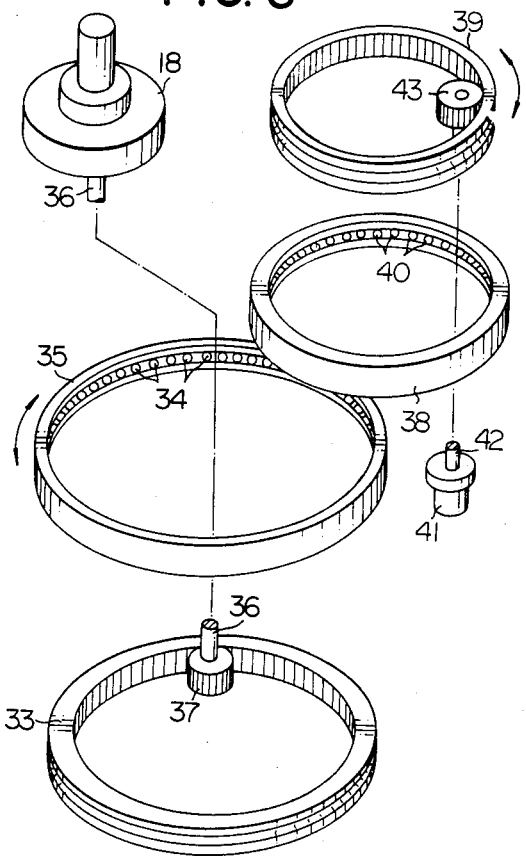
FIG. 6 is an exploded perspective view of a turning mechanism on the excavator shown in FIG. 1.
Figure 7:
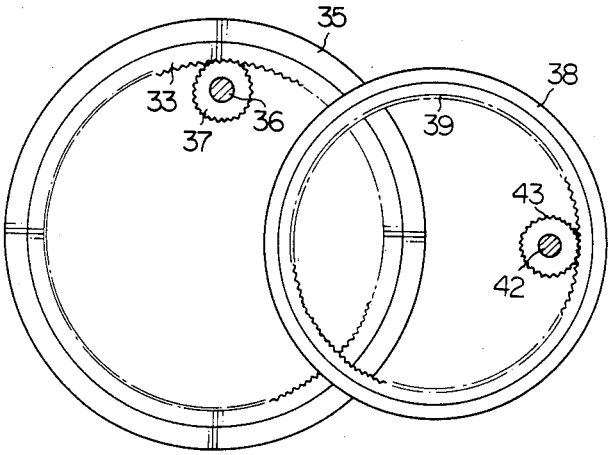
FIG. 7 is a plan view of the turning mechanism, as assembled, of FIG. 6.

As illustrated in FIGS. 5, 6 and 7, the excavator includes a mechanism for turning the turntable 14 and the carriage 20, the mechanism having an annular internal gear 33 fixedly mounted substantially concentrically on the annular flange of the support base 13. The turntable 14 has a slider ring 35 disposed securely therebelow and rotatably fitted over the internal gear 33 with ball bearings 34 interposed therebetween. Accordingly, the turntable 14 is rotatable coaxially on the first gear 33. A pinion 37 is fixed to the drive shaft 36 of the hydraulic motor 18 and held in driving mesh with the internal gear 33. The holder base 19 supports thereon an annular holder 38 affixed coaxially thereto. The carriage 20 has an annular internal gear 39 fixed to the underside thereof and rotatably fitted in the annular holder 38 with ball bearings 40 interposed therebetween. Therefore, the carriage 20 is rotatable coaxially with the annular holder 38. A second hydraulic motor 41 is mounted on the turntable 14 and located at a front end portion thereof within the holder base 19, and has an upwardly extending drive shaft 42 on which there is mounted a pinion 43 held in driving mesh with the internal gear 39. A first vertical post 44 is mounted centrally on the support base 13 in coaxial relation to the internal gear 33. A first angle detector 45 such as a rotary encoder is fixed to the underside of the turntable 14 in vertical alignment with the first vertical post 44, the first angle detector 45 and the first vertical post 44 being positioned adjacent to each other. A second vertical post 46 is mounted on the turntable 14 in coaxial relation to the internal gear 39. A second angle detector 47 such as a rotary encoder is fixed to the underside of the carriage 20 in vertical alignment with the second vertical post 46, the second angle detector 47 and the second vertical shaft 46 being positioned adjacent to each other.

Figure 8:
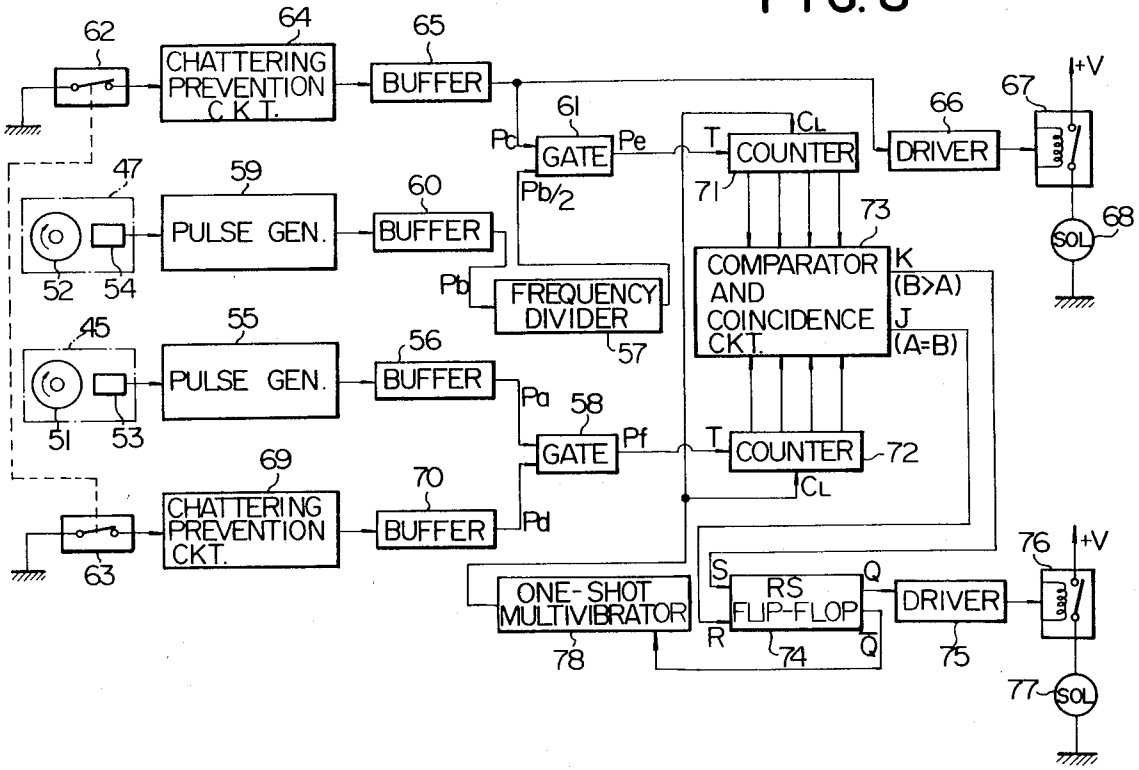
FIG. 8 is a block diagram of an electric control system for controlling the turning mechanism of FIG. 6.

FIG. 8 shows in block form an electric control system for detecting angular displacements of the turntable 14 and the carriage 20 and controlling the first and second hydraulic motors 18, 41. The first and second angle detectors 45, 47 are composed of magnetic disks 51, 52, respectively, each having magnetic poles arranged at equal angular intervals along the outer circumferential edge thereof, and magnetic pickups 53, 54, respectively, located adjacent to the magnetic disks 51, 52, respectively. The magnetic disks 51, 52 are attached to the upper ends of the vertical posts 44, 46, respectively. Thus, the magnetic disks 51, 52 are rotatable with respect to the turntable 14 and the carriage 20, respectively, as the turntable 14 and the carriage 20 are angularly moved about their own axes by the hydraulic motors 18, 41.

The magnetic pickup 53 issues an output signal to a pulse generator 55 which generates a train of pulses in response to the signal applied thereto. The pulse signal from the pulse generator 55 is fed through a buffer 56 to one of two input terminals of a gate 58. An output signal from the magnetic pickup 54 is supplied to a pulse generator 59. The pulse signal from the pulse generator 59 is fed through a buffer 60 to a frequency divider 57 by which the frequency of the pulse signal is reduced to half. The output signal from the frequency divider 57 is then applied to one of two input terminals of a gate 61. A pair of ganged switches 62, 63 is disposed on the control box 25 for actuating the hydraulic motors 18, 41 at the same time. The switch 62 is connected to a chattering prevention circuit 64 coupled via a buffer 65 to the other input terminal of the gate 61 and to a driver 66 connected to a relay 67 coupled between a power supply and a solenoid 68. The gate 61 has an output terminal connected to an input terminal T of a counter 71. The switch 63 is connected through a chattering prevention circuit 69 and a buffer 70 to the other input terminal of the gate 58. The gate 58 has an output terminal coupled to an input terminal T of a counter 72. The counters 71, 72 issue their output signals to a comparator and coincidence circuit 73 which generates a comparison output K when the output signals from the counters 71, 72 differ from each other and a coincidence output J when the output signals from the counters 71, 72 coincide with each other. The comparison output K is fed to a set terminal S of an RS flip-flop 74, and the coincidence output J is fed to a reset terminal R of the RS flip-flop 74. The RS flip-flop 74 has an output terminal Q connected to a driver 75 coupled to a relay 76 having one terminal connected to a power supply and the other terminal to a solenoid 77. The RS flip-flop 74 has an output terminal Q connected to a one-shot multivibrator 78 joined to clear terminals CL of the counters 71, 72.

Figure 9:
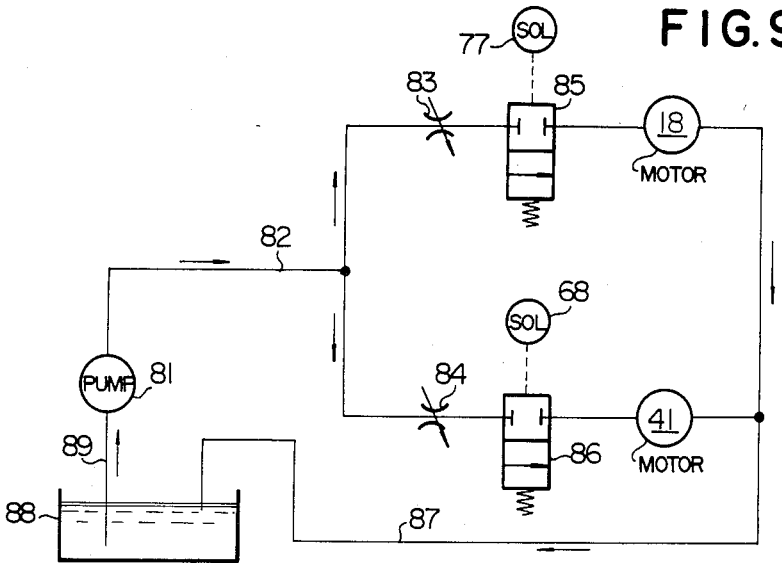
FIG. 9 is a circuit diagram showing a hydraulic driving system for actuating the turning mechanism shown in FIG. 6.

FIG. 9 is illustrative of a hydraulic driving system for driving the hydraulic motors 18, 41. The hydraulic driving system includes a hydraulic pump 81 and an oil discharge line 82 divided into two branches connected through restrictions 83, 84 to solenoid-operated valves 85, 86, respectively. The restrictions 83, 84 are designed such that the rate of flow through the restriction 84 is twice as high as that of the restriction 83. The solenoid-operated valve 85 is operated by the solenoid 77, while the solenoid-operated valve 86 is operated by the solenoid 68. The solenoid-operated valves 85, 86 are connected respectively to the hydraulic motors 18, 41, respectively, which are connected via an oil return line 87 to an oil tank 88 which contains oil under pressure. The hydraulic pump 81 has an oil supply line 89 connected to the oil tank 88.

Operation of the excavator thus constructed will now be described.

The operator sitting on the operator seat 24 operates on the control box 25 to actuate the hydraulic cylinders 30, 31, 32 for thereby moving the bucket 29 upwardly and downwardly to dig a trench in the well known manner. The material scooped up by the bucket 29 can be transferred to a truck or the like behind the excavator by lifting the bucket 29 to a horizontal position, as shown in FIG. 3, with the lower end of the bucket 29 slightly above the parts on the turntable 14 and then turning the bucket 29 rearwardly of the chassis 10.

The turntable 14 and the carriage 20 can be turned about their own axes by closing the switches 62, 63. While the switches 62, 63 are closed, a pulse Pc is supplied to the gate 61 and the driver 66 through the chattering prevention circuit 64 and the buffer 65 and a pulse Pd is supplied to the gate 58 through the chattering prevention circuit 69 and the buffer 70. In response to the pulse Pc, the driver 66 energizes the relay 67 to supply a current to the solenoid 68 to thereby actuate the solenoid-operated valve 86 for supplying oil under pressure from the hydraulic pump 81 through the restriction 84 to the hydraulic motor 41. Now, the drive shaft 42 of the hydraulic motor 41 and hence the pinion 43 are rotated to cause the internal gear 39 to rotate in the annular holder 38. Therefore, the carriage 20 disposed on the internal gear 39 and supporting thereon the vertical support 21 and the excavating mechanism 48 is angularly moved with respect to the turntable 14.

It is assumed that the comparator and coincidence circuit 73 issues the coincidence signal J prior to the closing of the switches 62, 63. Then, the comparator and coincidence circuit 73 issues the comparison signal K to trigger the RS flip-flop 74 to issue an output signal Q to the driver 75 which then closes the relay 76, whereupon the solenoid 77 is energized. The solenoid-operated valve 77 is energized to allow oil under pressure to be supplied from the hydraulic pump 81 through the restriction 83 to the hydraulic motor 18. The drive shaft 36 and the pinion 37 of the hydraulic motor 18 are now rotated to enable the slider ring 35 to turn along the internal gear 33, whereupon the turntable 14 is angularly moved with respect to the chassis 10. The hydraulic motors 18, 41 are arranged such that they rotate in opposite directions. Therefore, the turntable 14 and the carriage 20 rotate in opposite directions, allowing the excavating mechanism 48 on the carriage 20 to pass over the turntable 14. Since the restriction 84 permits oil to flow therethrough at twice a rate as the flow rate of oil through the restriction 83, the carriage 20 rotates at a speed twice higher than the speed of rotation of the turntable 14.

When the turntable 14 and the carriage 20 are thus rotated, the angle detectors 45, 47 are rotated relatively to the vertical posts 44, 46, respectively. Since the magnetic disks 51, 52 in the angle detectors 45, 47 are attached to the vertical posts 44, 46, respectively, they rotate in the angle detectors 45, 47, and the magnetic pickups 53, 54 detect movements of the magnetic poles on the magnetic disks 51, 52 and issue electric signals to the pulse generators 55, 59. In response to the applied electric signals, the pulse generators 55, 59 produce pulse signals having a predetermined pulse duration each time the magnetic disks 51, 52 are turned through a certain angle. The pulse signals from the pulse generators 55, 59 are delivered through the buffers 56, 60 as angle signals Pa, Pb to the gate 58 and the frequency divider 57, respectively. The angle signal Pb is converted by the frequency divider 57 into a signal Pb/2 having a half frequency, and applies the signal Pb/2 to the gate 61. While the signal Pc and the signal Pb/2 are being supplied, the gate 61 issues a pulse signal Pe which is the same as the angle signal Pb/2 to the input terminal T of the counter 71 which then counts the pulses and supplies a count output B to the comparator and coincidence circuit 73. While the signal Pa and the signal Pd are being supplied, the gate 58 issues a pulse signal Pf equal to the signal Pa to the input terminal T of the counter 72. The pulses of the pulse signal Pf are counted by the counter 72, which issues a count output A to the comparator and coincidence circuit 73. As described above, the comparator and coincidence circuit 73 issues the comparison output K when the count outputs A, B are different from each other, or the count output B is greater than the count output A, and the coincidence signal J when the count outputs A, B coincide with each other. Where the comparison output K from the comparator and coincidence circuit 73 is of a level "1", the output terminal Q of the RS flip-flop 74 issues an output signal "1" to keep the hydraulic motor 18 actuated to rotate the turntable 14. When the angle of rotation of the turntable 14 reaches an angle half that of rotation of the carriage 20, the count outputs A, B from the counters 72, 71 coincide with each other, whereupon the comparator and coincidence circuit 73 issues the coincidence output J of "1". The RS flip-flop 74 is now toggled to cause the output terminal Q to produce a signal of "0" for de-energizing the driver 75. The relay 76 is thus opened to inactivate the hydraulic motor 18 temporarily to thereby interrupt the movement of the turntable 14. At the same time, the output terminal $\overline{Q}$ of the RS flip-flop 74 produces a signal "1" to enable the one-shot multivibrator 78 to issue one pulse of a predetermined duration to the clear terminals CL of the counters 71, 72 to clear the counts therein. The counters 71, 72 then start counting the pulses of the pulse signals Pe, Pf again. Accordingly, the comparator and coincidence circuit 73 alternately issues the comparison output K and the coincidence output J to control the solenoid 77 and the hydraulic motor 18 stepwise for reducing accumulated errors and causing the hydraulic motor 18 to follow the hydraulic motor 41 in a certain operative condition. The magnetic disks 51, 52 therefore rotate at an angular displacement ratio of 1:2, so that the turntable 14 and the carriage 20 rotate in proportion at an angular displacement ratio of 1:2 at all times. If the angular displacement of the carriage 20 becomes greater than that of the turntable 14, then the comparator and coincidence circuit 73 applies the comparison output K to the RS flip-flop 74 to energize the driver 75, the relay 76, and the solenoid 77 for thereby actuating the hydraulic motor 18. Thus, any relative angular displacement error which the turntable 14 and the carriage 20 would suffer is held to a minimum.

Figure 10A:
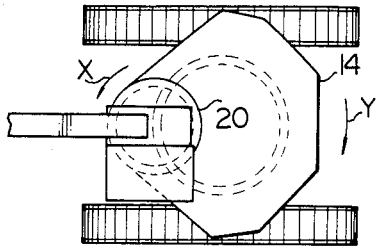
FIGS. 10A through 10C are plan views showing successive angular positions of a turntable and a carriage of the excavator shown in FIG. 1.
Figure 10B:
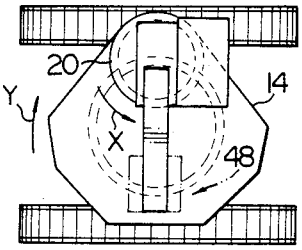

The relative angular displacement of the turntable 14 and the carriage 20 thus rotated by the hydraulic motors 18, 41 will be described with reference to FIGS. 10A through 10C. As shown in FIG. 10A, the carriage 20 starts rotating in the direction of the arrow X, and the turntable 14 starts rotating in the direction of the arrow Y. As described above, the carriage 20 and the turntable 14 are controlled to turn at an angular displacement ratio of 1:2. Therefore, the carriage 20 rotates at a speed twice higher than the speed of rotation of the turntable 14. When the turntable 14 rotates through 90 degrees, the carriage 20 rotates through 180 degrees. Since the turntable 14 and the carriage 20 rotate in the opposite directions, they relatively rotate through 90 degrees. The excavating mechanism 48 is positioned at a right angle to the longitudinal axis of the chassis 10 as shown in FIG. 10B. At this time, the carriage 20 is displaced on one side of the chassis 10 to a maximum extent, with the excavating mechanism 48 moving over the turntable 14 without projecting sideways from the other side of the chassis 10. When the turntable 14 is further rotated through another 90 degrees, the carriage 20 rotates through 180 degrees to the opposite end of the chassis 10, at which time the excavating mechanism 48 projects from the end of the chassis 10 in a position shown in FIG. 10C which is 180 degrees inverted from the position of FIG. 10A. When the turntable 14 and the carriage 20 reach the position of FIG. 10C, the switches 62, 63 are released to stop the operation of the hydraulic motors 18, 41 thus stopping the rotation of the turntable 14 and the carriage 20. Accordingly, the excavating mechanism 48 is turned on the basis of the turning movement of the turntable 14 on the chassis 10 and the opposite turning movement of the carriage 20 on the turntable 14, so that the excavating mechanism 48 will move from a forward position to a rearward position across and over the turntable 14 while rotating in a range in which the excavating mechanism 48 will not project laterally of the chassis 10. When it is necessary to turn the excavating mechanism 48 back from the position of FIG. 10C to the position of FIG. 10A, the switches 62, 63 are depressed again to cause the turntable 14 to turn 180 degrees the carriage 20 to rotate at a certain ratio to the rotation of the turntable 14 in the foregoing manner.

With the foregoing arrangement, the bucket of the excavator can be turned back and forth in eccectric relation to the center of the excavator without projecting laterally of the chassis 10. Therefore, the operation of the exacavator will not interfere with surrounding traffic and/or objects. Where the excavator is employed for road construction, the operation of the excavator is confined to a minimum area so that the available space on the road may not be occupied by the excavator and the road can be used by as much traffic as possible efficiently. Where the road under construction has a width substantially the same as that of the excavator, the excavator can operate in such a small space since the bucket will not project laterally beyond the width of the excavator. Since the turntable and the carriage are rotated by the respective hydraulic motors, and their angular displacements are detected by the angle detectors and controlled to be kept at a certain ratio, the excavator mechanism on the carriage is allowed to move smoothly across and over the turntable. There is no complex mechanism used for maintaining the turntable and the carriage to turn at a selected ratio, and hence the driving system is subjected to no undue stresses or energy loss.

Figure 11:
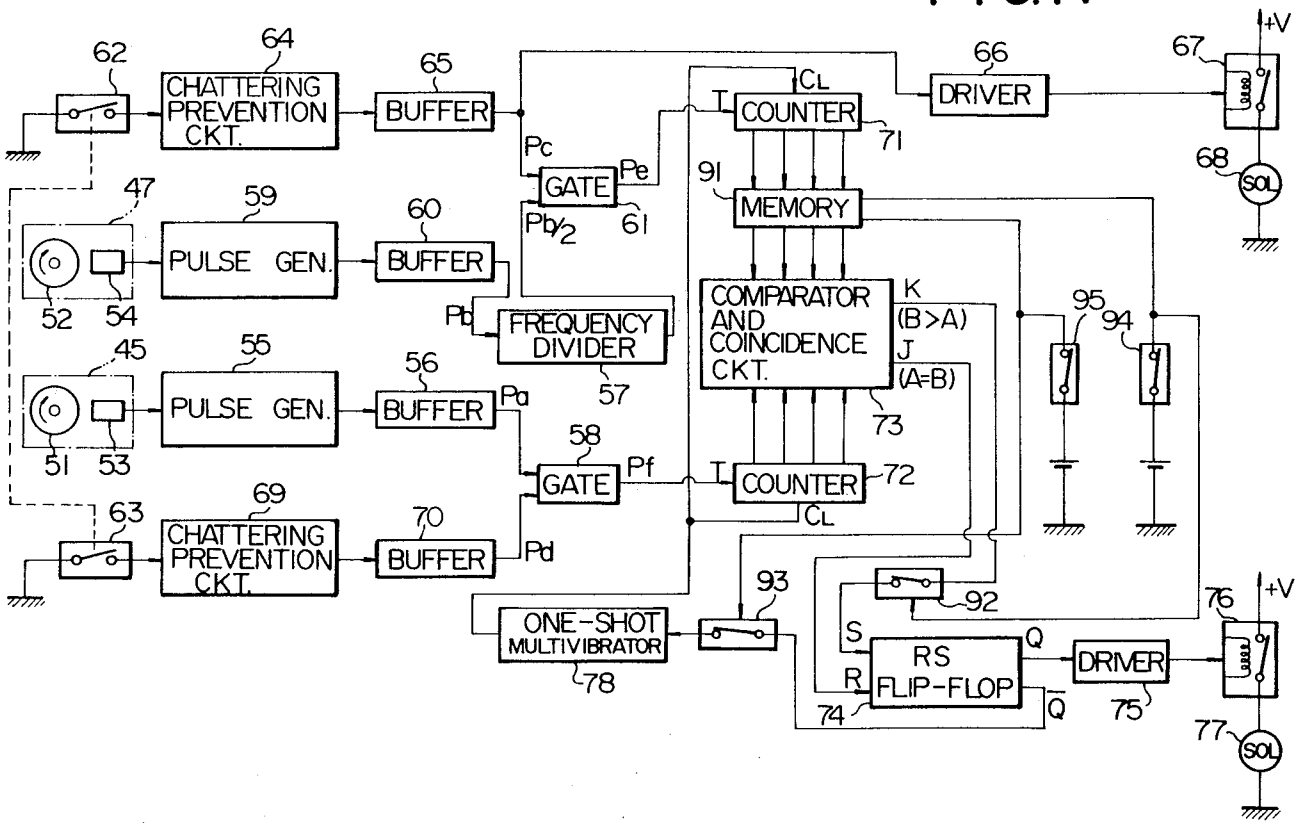
FIG. 11 is a block diagram of an electric control system according to another embodiment of the present invention.

FIG. 11 shows an electric control system according to another embodiment. The electric control system shown in FIG. 11 differs from the electric control system illustrated in FIG. 8 in that there is a memory 91 connected between the counter 71 and the comparator and coincidence circuit 73, the comparison output K from the comparator and coincidence circuit 73 is fed through a normally closed switch 92 to the set input terminal S of the RS flip-flop 74, and the output terminal $\overline{Q}$ of the RS flip-flop 74 is connected through another normally closed switch 93 to the one-shot multivibrator 78. In addition, a memory switch 94 and a memory control switch 95 are provided on the control box 25. The memory switch 94 issues an output signal to the memory 91 and the normally closed switch 92, and the memory control switch 95 issues an output signal to the memory 91 and the normally closed switch 93. The memory 91 serves to deliver an output signal from the counter 71 to the comparator and coincidence circuit 73 in the absence of a command signal, and to store the count from the counter 71, then reduce the stored count, and then supply the modified count signal to the comparator and coincidence circuit 73 in the presence of the command signal.

Figure 12:
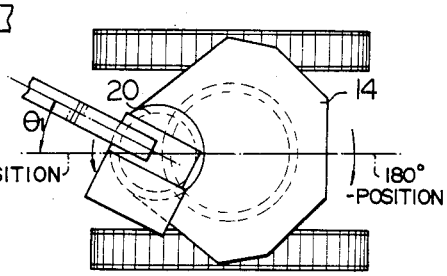
FIG. 12 is a plan view of a turntable and a carriage which are angularly moved under the control of the electric control system shown in FIG. 11.

Operation of the above electric control system will be described with reference FIGS. 9, 11 and 12. When it is desired to angularly displace the carriage 20 through a certain angle from the longitudinal axis of the carriage 10 while the turntable 14 is directed forward, the memory switch 94 is first closed to keep the memory 91 in a storage mode and the switch 92 is opened to disconnect the RS flip-flop 74 from the comparator and coincidence circuit 73. When the switches 62, 63 are closed, the driver 66, the relay 67, and the solenoid 68 are actuated in the manner described to enable the hydraulic motor 41 to rotate the carriage 20. Since the switch 92 is open at this time, the driver 75, the relay 76, the solenoid 77, and the hydraulic motor 18 are inactivated, and hence the turntable 14 remains stopped. After the carriage 20 has turned through a desired angle, the switches 62, 63 are opened. Now the carriage 20 is stopped in a postion angularly displaced $\theta_1$ clockwise from the longitudinal axis of the chassis 10 with the turntable 14 directed forward as shown in FIG. 12. The angle $\theta_1$ of displacement of the carriage 20 is detected as a number of pulses that are stored into the memory 91 through the counter 71. The stored angle is held in the memory 91 and will not be erased by opening the memory switch 94. For repeating the operation to transfer the scooped material in the bucket from the angularly displaced postion of FIG. 12 to the position behind the chassis 10, the memory control switch 95 is closed to effect control for the displacement angle stored in the memory 91 and open the switch 93 for disabling the one-shot multivibrator 78 so that the counters 71, 72 will not be reset. When the switches 62, 63 are closed with the memory control switch 95 closed, the hydraulic motor 41 is actuated to turn the carriage 20. The angle of the turning movement of the carriage 20 is detected by the magnetic pickup 54 which issues pulses to the counter 71. However, the memory 91 issues no signal and hence maintains an output indicative of the pulse number "0" until the number of pulses fed to the counter 71 reaches the number of pulses that have been stored in the memory 91. Since the count output B from the memory 91 at this time is the same as the initial count output A "0" from the counter 72, the comparator and coincidence circuit 73 issues the coincidence signal J, whereupon the output terminal Q of the RS flip-flop 74 is of "1" and the hydraulic motor 18 is not actuated. Therefore, the turntable 14 is not rotated, and the only the carriage 20 is rotated through the predetermined displacement angle $\theta_1$. When the carriage 20 is rotated through the predetermined displacement angle $\theta_1$, the angular displacement for the carriage 20 becomes "0" and from this time on the memory 91 supplies the comparator and coincidence circuit 73 with a count which is the difference between the count from the counter 71 and the displacement angle $\theta_1$. The comparator and coincidence circuit 73 now issues the comparison signal K to cause the hydraulic motor 18 to start rotating, thus rotating the turntable 14 to follow the rotation of the carriage 20. The turntable 14 and the carriage 20 then operate in the same manner described above so that they move synchronously through the positions of FIGS. 10B and 10C until the carriage 20 is stopped in the 180°-inverted position. With the memory control switch 95 closed, the carriage 20 is stopped or starts operating at the angular position $\theta_1$ at all times. Therefore, the excavating mechanism 48 can be oriented obliquely forward as shown in FIG. 12 for digging operation. The initial angular position of the carriage 20 may be varied or returned to the normal position simply by closing the memory switch 94 and rotating the carriage 20 to a desired angular position.

With the modified electric control system shown in FIG. 11, the carriage can freely be angularly positioned with respect to the predetermined stop position of the turntable. Consequently, the range of operation of the excavator can be widened without moving the chassis thereof.

Figure 13:
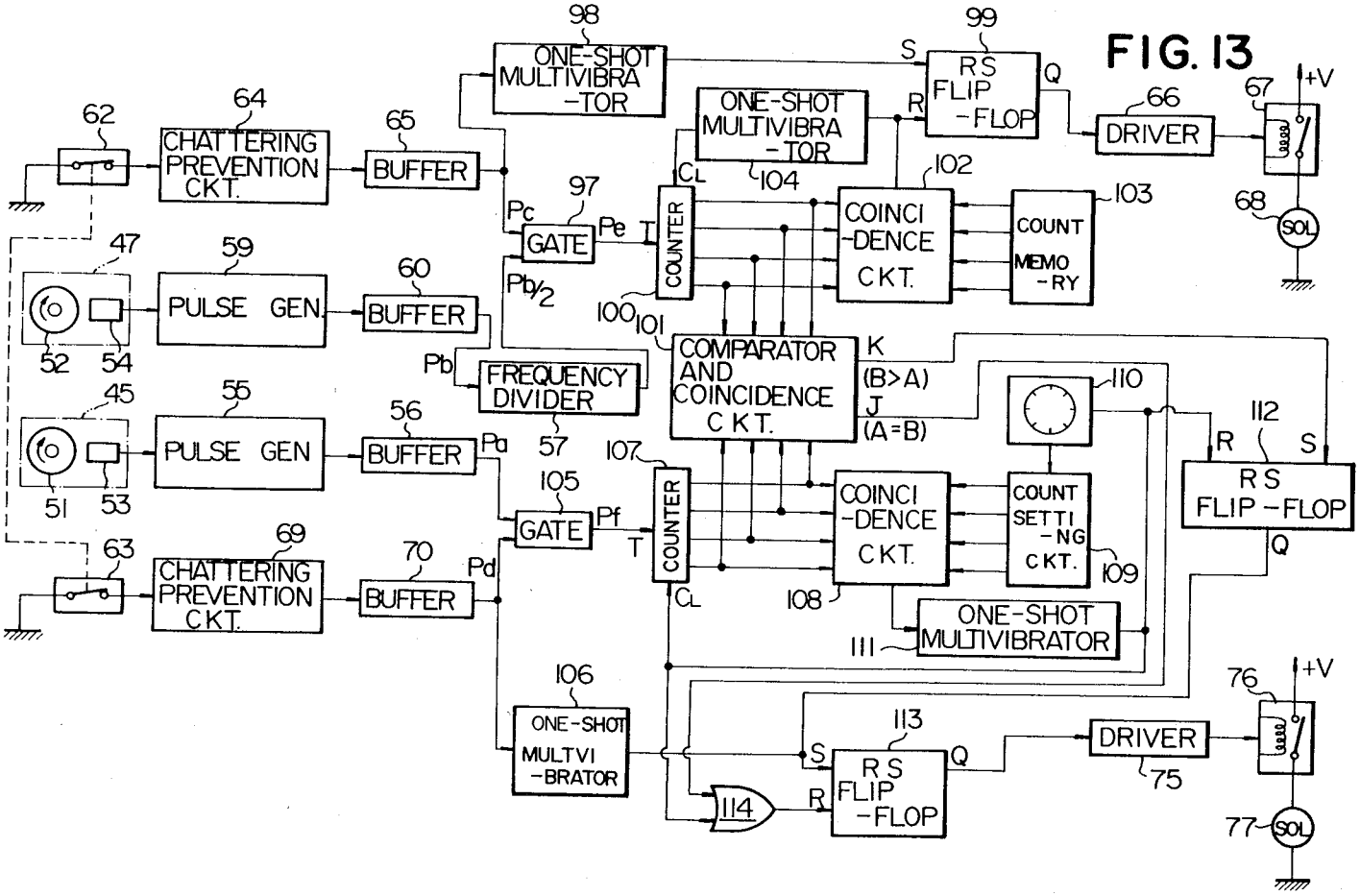
FIG. 13 is a block diagram of an electric control system according to still another embodiment of the present invention.

FIG. 13 illustrates in block form an electric control system according to still another embodiment of the present invention. As shown in FIG. 13, the buffer 65 is connected to a gate 97 and a one-shot multivibrator 98, and the buffer 60 is connected through the frequency divider 57 to the gate 97. The one-shot multivibrator 98 has an output terminal connected to a set terminal S of an RS flip-flop 99 having an output terminal Q coupled via the driver 66 to the relay 67. The gate 97 has an output terminal coupled to an input terminal T of a counter 100. The buffers 56, 70 are connected to a gate 105, the buffer 70 being also connected to a one-shot multivibrator 106. The gate 105 has an output terminal connected to an input terminal T of a counter 107. The counters 100, 107 have output terminals connected to a comparator and coincidence circuit 101. The counter 100 is also connected to a coincidence circuit 102 which is receptive of an input signal from a count memory 103. The count memory 103 serves to issue, at all times, a signal representative of a fixed count indicating 360°-revolution of the carriage 20. An output from the coincidence circuit 102 is fed to a reset terminal R of the RS flip-flop 99 and a one-shot multivibrator 104 having an output terminal coupled to a clear terminal CL of the counter 100. The counter 107 is also connected to a coincidence circuit 108 receptive of an input signal from a count setting circuit 109 which is indicative of a preset count. To the count setting circuit 109, there is connected an angular displacement setting dial 110 which serves to set a stop position for the turntable 14. the angular displacement setting dial 110 has a 180°-scale indication and is capable of setting two different count numbers. An output signal from the coincidence circuit 108 is applied to a one-shot multivibrator 111. The comparator and coincidence circuit 101 serves to compare the counts from the counters 100, 107. The comparator and coincidence circuit 101 issues a comparison output K when the counts from the counters 100, 107 differ from each other and a coincidence output J when the counts from the counters 100, 107 coincide with each other. The comparison output K is fed to a set terminal S of an RS flip-flop 112, and the coincidence output J is fed to an OR gate 114 the output of which is fed to a reset terminal R of an RS flip-flop 113. The RS flip-flop 112 has an output terminal Q coupled to a set terminal S of the RS flip-flop 113. The one-shot multivibrator 111 has an output terminal connected to the setting dial 110, a reset terminal R of the RS flip-flop 112, the OR gate 114, and a clear terminal CL of the counter 107. The one-shot multivibrator 106 has an output terminal connected to the set terminal S of the RS flip-flop 113 which has an output terminal Q connected to the driver 75 coupled to the relay 76.

Figure 14A:
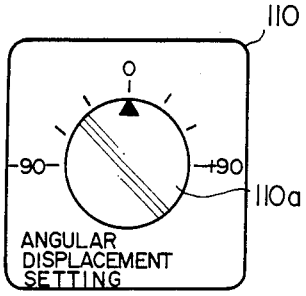
FIG. 14A illustrates an angular displacement setting dial in the electric control system of FIG. 13.

The electric control system shown in FIG. 13 operates as follows:

When the turntable 14 is to be turned successively through angular intervals of 180 degrees and then stopped, a pointer on the setting dial 110 is set to the position "0" as shown in FIG. 14A. Then, the count setting circuit 109 issues a signal indicative of a count which respresents a 180°-rotation, so that it can set such a 180°-signal each time a signal is applied from the one-shot multivibrator 111.

For rotating the turntable 14 and the carriage 20, the switches 62, 63 are closed to supply pulses Pc, Pd through the chattering prevention circuits 64, 69 and the buffers 65, 70 to the one-shot multivibrators 98, 106 and the gates 97, 105. These pulses are kept applied while the switches 62, 63 remain closed. The one-shot multivibrators 98, 106 issues pulses of predetermined durations to the RS flip-flops 99, 113, respectively, which cause outputs from the terminals Q thereof to go high, whereupon the drivers 66, 75 close the relays 67, 76 for thereby energizing the solenoids 68, 77 to actuate the solenoid-operated valves 86, 85 (FIG. 9). The oil under pressure is now supplied from the hydraulic pump 81 through the restrictions 83, 84 to the hydraulic motors 18, 41. Accordingly, the turntable 14 and the carriage 20 are rotated at the angular displacement ratio of 1:2 in the manner described above.

When the turntable 14 and the carriage 20 are thus rotated, the gates 97, 105 are supplied with the pulse signals Pb/2, Pd, respectively. Since the signals Pc, Pa have been fed to the gates 97, 105, they allow the pulse signals Pb/2, Pd to go as pulse signals Pe, Pf to the input terminals T of the counters 100, 107, respectively. The counter 100 counts the applied pulses Pe and issues a count output B to the comparator and coincidence circuit 101 and the coincidence circuit 102. The counter 107 counts the applied pulses Pf and issues a count output A to the comparator and coincidence circuit 101 and the coincidence circuit 108. The comparator and coincidence circuit 101 compares the count outputs from the counters 100, 107 and issues the comparison output K when the count output B is greater than the count output A and the coincidence output J when the count outputs A, B are equal to each other. As long as the comparison output K is generated, the output terminal Q of the RS flip-flop 112 issues a signal of "1" to keep the hydraulic motor 18 actuated. When the angle of rotation of the turntable 14 rotated by the hydraulic motor 18 reaches half of the angle of rotation of the carriage 20, the count outputs B, A from the counters 100, 107 coincide with each other, whereupon the comparison and coincidence circuit 101 issues the coincidence signal J through the OR gate 114 to the reset terminal R of the RS flip-flop 113. The signal from the output terminal Q of the RS flip-flop 113 now becomes "0" to thereby de-energize the driver 75. The relay 76 is opened and the hydraulic motor 18 is temporarily stopped, thus interrupting the rotation of the turntable 14. Accordingly, the counters 100, 107 count the pulses of the pulse signals Pe, Pf and the comparator and coincidence circuit 101 alternately issues the comparison output K and the coincidence output J to control the solenoid 77 and the hydraulic motor 18 stepwise for reducing any accumulated errors and causing the hydraulic motor 18 to follow the hydraulic motor 41 in a certain operative condition. The magnetic disks 51, 52 therefore rotate at an angular displacement ratio of 1:2, so that the turntable 14 and the carriage 20 rotate in proportion at an angular displacement ratio of 1:2 at all times. If the angular displacement of the carriage 20 becomes greater than that of the turntable 14, then the comparator and coincidence circuit 101 applies the comparison output K to the RS flip-flop 112 to energize the driver 75, the relay 76, and the solenoid 77 for thereby actuate the hydraulic motor 18. Thus, any relative angular displacement error which the turntable 14 and the carriage 20 would suffer is held to a minimum.

Since the count outputs from the counters 100, 107 are also applied to the coincidence circuits 102, 108, respectively, the latter compare these count outputs with count settings supplied from the count memory 103 and the count setting circuit 109. When a count number indicative of the 360°-revolution of the carriage 20 is reached, the coincidence circuit 102 issues a signal to trigger the RS flip-flop 99 for thereby causing the driver 66, the relay 67, the solenoid 68, and the solenoid-operated valve 86 to stop the rotation of the hydraulic motor 41, and at the same time enabling the one-shot multivibrator 104 to clear the counter 100. The coincidence circuit 108 compares the count output A from the counter 107 with a count setting from the count setting circuit 109. When a count number indicative of the 180°-rotation of the turntable 14 is reached, the coincidence circuit 108 issues a signal to the one-shot multivibrator 111 which issues a signal to the setting dial 110, the RS flip-flop 112, the counter 107, and through the OR gate 114 to the RS flip-flop 113. Therefore, the setting dial 110 then sets a next count, and the RS flip-flops 112, 113 are inverted, and the counter 107 is cleared. Since the RS flip-flop 113 is inverted, no signal is fed to the driver 75, and the hydraulic motor 18 is stopped. As a consequence, the turntable 14 is stopped after the angular movement through 180° degrees, and the carriage 20 is stopped after the revolution through 360 degrees.

Figure 14B:
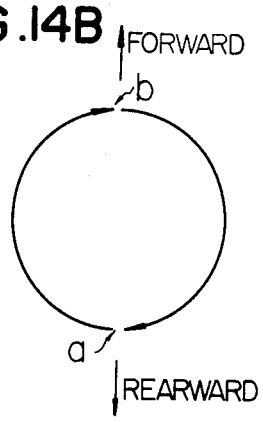
FIG. 14B shows a pattern of angular displacement of the turntable selected by the setting on the dial of FIG. 14A.

The angular displacement setting dial 110 will be described in more detail with reference to FIGS. 14A and 14B. With a knob 110*a* of the setting dial 110 being pointed to the displacement angle "0", the setting dial 110 causes the count setting circuit 109 to issue a count signal representative of the 180°-rotation of the turntable 14 in response to one signal input from the one-shot multivibrator 111. Therefore, while the turntable 14 is rotating from a rearward point a to a forward point b (FIG. 14B) on the chassis 10, the count setting circuit 109 issues a preset count signal. When the point b is reached by the turntable 14, the setting dial 110 is reset by the signal from the one-shot multivibrator 111. During subsequent angular movement of the turntable 14 from the point b to the point a, the count setting circuit 109 issues a preset count signal indicative of the 180°-rotation. Therefore, while the setting dial 110 is set to the displacement angle "0", the turntable 14 repeatedly rotates through 180 degrees and stops, that is, the turntable 14 is caused to stop in forward and rearward positions at all times.

Figure 15A:
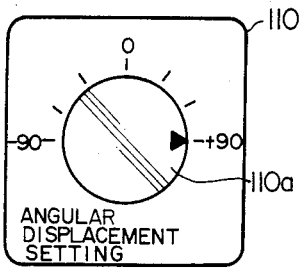
FIG. 15A is similar to FIG. 14A, showing another angular displacement setting.
Figure 15B:
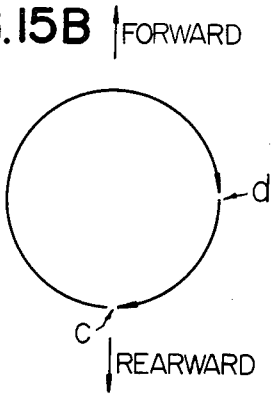
FIG. 15B is similar to FIG. 14B, showing another pattern of angular displacement of the turntable selected by the setting on the dial shown in FIG. 15A.

For turning the turntable 14 through a right angle to one side of the chassis 10, the knob 110*a* of the setting dial 110 is set to +90 degrees as shown in FIG. 15A. The setting dial 110 alternately issues two different signals to the count setting circuit 109 to transmit a preset count corresponding to 90°-rotation and a preset count corresponding to 270°-rotation to the coincidence circuit 78. More specifically, when the turntable 14 is to be rotated clockwise from a point c to a point d (FIG. 15B), the setting dial 110 causes the count setting circuit 109 to supply the count indicative of the 270°-rotation of the turntable 14 to the coincidence circuit 108. After the turntable 14 has rotated through 270 degrees, it stops at the point d. Then, when the turntable 14 is to be rotated clockwise from the point d to the point c, the setting dial 110 causes the count setting circuit 109 to supply the count indiative of the 90°-rotation of the turntable 14 to the coincidence circuit 108. After the turntable 14 has rotated through 90 degrees, it stops at the point c.

The above angular movement of the turntable 14 is initiated when the switches 62, 63 are closed. The pulses detected by the magnetic pickups 53, 54 are counted by the counters 100, 107 and the count signals are fed to the coincidence circuits 102, 108. Since the coincidence circuit 102 has the count indicative of the 360°-revolution of the carriage 20, the coincidence circuit 102 issues a signal to stop the hydraulic motor 41 when the carriage 20 has rotated through 360 degrees. The coincidence circuit 108 is supplied with the signal from the count setting circuit 109 when the turntable 14 has rotated through 270 degrees, whereupon the one-shot multivibrator 111 stops the rotation of the hydraulic motor 18. Simultaneously, the one-shot multivibrator 111 delivers a signal to the setting dial 110 to indicate a next preset count for setting a count indicative of 90°-rotation in the count setting circuit 109. Accordingly, the carriage 20 rotates through 360 degrees while the turntable 14 stops after it has turned through 270 degrees. When the switches 62, 63 are closed again, the carriage 20 rotates through 360 degrees before it stops, and the turntable 14 rotates through 90 degrees before it stops. Thus, the carriage 20 and the turntable 14 return to their original positions. Summarized, when the switches 62, 63 are closed at the first time, the turntable 14 rotates through 270 degrees and stops, and when the switches 62, 63 are closed at the second time, the turntable 14 rotates through 90 degrees and stops.

Figure 16A:
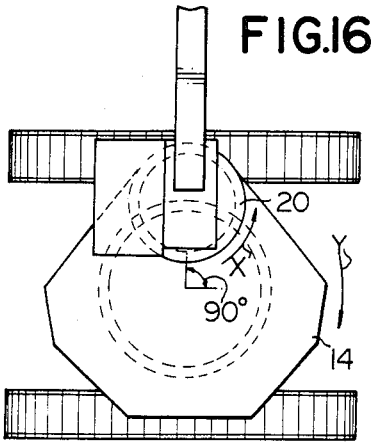
FIGS. 16A and 16B are plan views illustrative of angular positions of the turntable and the carriage turned under the control of the electric control system of FIG. 13.
Figure 16B:
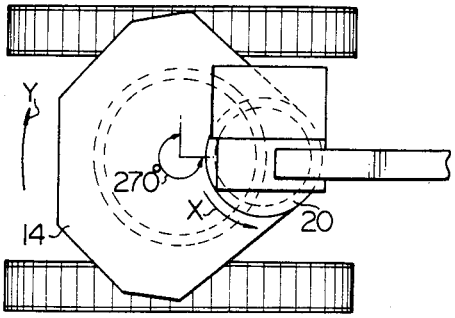

The foregoing movements of the turntable 14 and the carriage 20 will be described with reference to FIGS. 16A and 16B. The position of the turntable 14 in FIG. 16A corresponds to the point d in FIG. 15B. When the switches 62, 63 are depressed in the position 16A, the turntable 14 rotates through 90 degrees and stops, and the carriage 20 rotates through 360 degrees and stops, as shown in FIG. 16B. The excavating mechanism 48 is directed rearward of the chassis 10 to dump the scooped material onto a truck or the like behind the chassis 10. When the switches 62, 63 are closed again, the turntable 14 rotates through 270 degrees, and the carriage 20 rotates through 360 degrees, before they return to the starting position shown in FIG. 16A. The excavating mechanism 48 now projects laterally of the chassis 10 to effect excavating operation sideways of the chassis 10. The angular position at which the turntable 14 is to be stopped can be selected as desired by turning the knob 110*a* of the angular displacement setting dial 110.

The electric control system shown in FIG. 13 is advantageous in that the turntable can be angularly moved through any desired angles and stopped at any desired angular positions for enabling the excavating mechanism to be directed and operated in a wide range.

Figure 17:
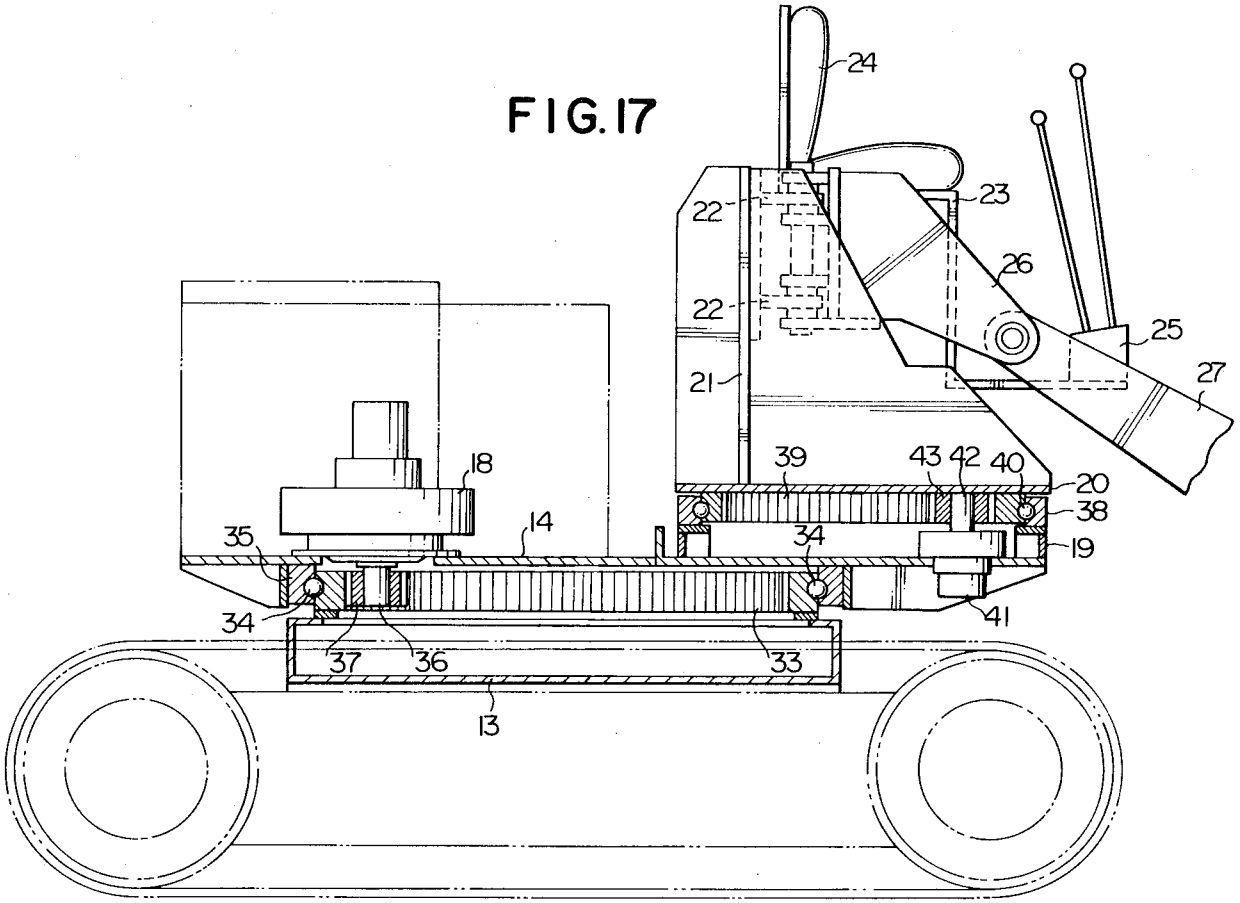
FIG. 17 is a fragmentary vertical cross-sectional view of an excavator according to still another embodiment of the present invention.
Figure 18:
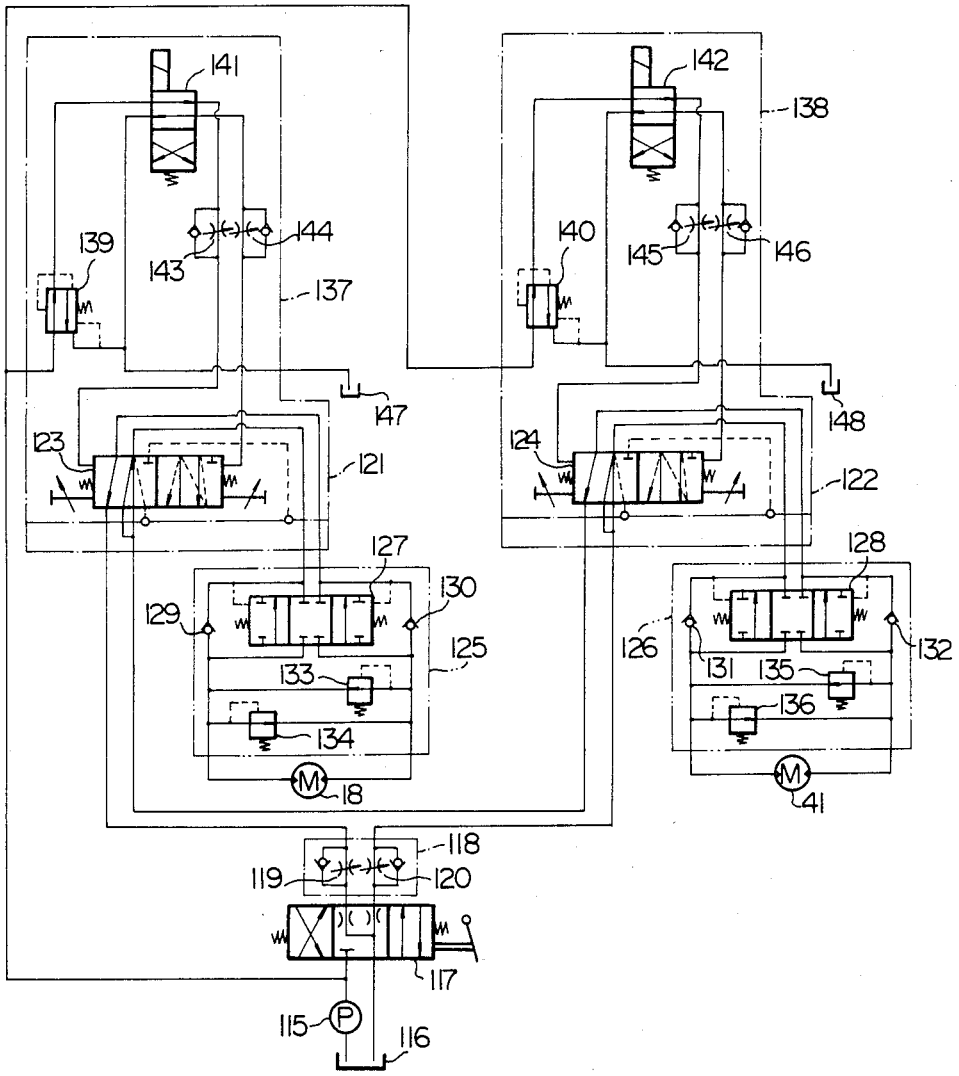
FIG. 18 is a circuit diagram of a hydraulic driving system for actuating a turntable and a carriage of the excavator shown in FIG. 17.

According to a still further embodiment of the present invention as shown in FIGS. 17 and 18, an excavator is different from that illustrated in FIG. 5 in that there are no vertical posts 44, 46 and no angle detectors 45, 47, as illustrated in FIG. 17.

FIG. 18 shows a hydraulic driving system for driving the hydraulic motors 18, 41. A pump 115 driven by an engine (not shown) has an inlet port communicating with a tank 116 of working oil and an outlet port connected to a directional control valve 117 having a discharge port communicating with the tank 116. The directional control valve 117 is connected to two restrictions 119, 120 in a flow rate control 118. The restriction 119 is connected to a directional control valve 123 in a switching unit 121, and the restriction 120 is connected to a directional control valve 124 in a switching unit 122. The directional control valves 123, 124 are connected to each other. The directional control valves 123, 124 can be switched under hydraulic pressure between a first mode of operation in which oil under pressure is supplied to both the hydraulic motors 18, 41 and a second mode of operation in which oil under pressure is fed back to the directional control valves 124, 123. To the directional control valve 123, there is connected a automatic directional control valve 127 in a motor drive unit 125. The automatic directional control valve 127 is capable of changing directions of oil flow paths automatically dependent on the direction of flow of oil and is coupled to the hydraulic motor 18. The motor drive unit 125 includes a pair of check valves 129, 130 connected between the directional control valve 123 and the hydraulic motor 18. A pair of parallel, oppositely directed relief valves 133, 134 is connected across the hydraulic motor 18. Likewise, another motor drive unit 126 includes an automatic directional control valve 128 connected to the directional control valve 124 and the hydraulic motor 41. The automatic directional control valve 128 is capable of changing directions of oil flow paths automatically dependent on the direction of flow of oil. The motor drive unit 126 includes a pair of check valves 131, 132 connected between the directional control valve 124 and the hydraulic motor 41. A pair of parallel, oppositely directed relief valves 135, 136 is connected across the hydraulic motor 41. The outlet port of the hydraulic pump 115 is also connected through two-port relief valves 139, 140 to solenoid-operated valves 141, 142 in flow-path control units 137, 138, respectively. The solenoid-operated valve 141 has two ports connected through restrictions 143, 144 to control ports of the directional control valve 123 and has an outlet port connected to the relief valve 139 and a drain tank 147. Likewise, the solenoid-operated valve 142 has two ports connected through restrictions 145, 146 to control ports of the directional control valve 124 and has an outlet port connected to the relief valve 140 and a drain tank 148.

Operation of the hydraulic driving system shown in FIG. 18 is as follows:

(1) Synchronous rotation of the turntable 14 and the carriage 20:

The solenoid-operated valves 141, 142 are inactivated to put the directional control valves 123, 124 in a supply mode for supplying oil under pressure to the hydraulic motors 18, 41.

A portion of oil from the hydraulic pump 115 is delivered through the relief valves 139, 140 and the solenoid-operated valves 141, 142 to one of the control ports of each of the directional control valves 123, 124 for thereby keeping the latter in the supply mode. When the directional control valve 117 is shifted to a "normal" position at this time, oil under pressure is supplied through the restriction 119 and the directional control valve 123 to the motor drive unit 125 in which the automatic directional control valve 127 is shifted from a "neutral" position to a "conductive" position. At the same time, oil under pressure is returned through the check valve 130 to the hydraulic motor 18 and then through the automatic directional control valve 127 as shifted back to the directional control valve 123. The oil having passed through the hydraulic motor 18 enters from the directional control valve 123 to the directional control valve 124, and then shifts the automatic directional control valve 128 to a conductive position and simultaneously goes through the check valve 132 to the hydraulic motor 41. The oil from the hydraulic motor 41 passes through the automatic directional control valve 128 as shifted back to the directional control valve 124, and thence flows through the restriction 120 and the directional control valve 117 back into the tank 116. Accordingly, by shifting the directional control valve 117 to the "normal" position, a closed-loop flow path is completed to connect the hydraulic motors 18, 41 in series with each other and rotate them. When the hydraulic motors 18, 41 are rotated, the turntable 14 and the carriage 20 are rotated thereby in the manner described previously. The capacities of the hydraulic motors 18, 41, the numbers of teeth of the pinions 37, 43 and the internal gears 33, 39 are selected such that the carriage 20 will rotate at a speed twice the speed of rotation of the turntable 14. The turntable 14 and the carriage 20 are relatively angularly moved as shown in FIGS. 10A through 10C. The turntable 14 and the carriage 20 are stopped in their rotation when the directional control valve 117 is returned to a "neutral" position. When it is desired to turn the excavating mechanism from the position of FIG. 10C back to the position of FIG. 10A, the direction control valve 117 is shifted again to the "normal" position to rotate the turntable 14 through an additional 180 degrees. The turntable 14 and the carriage 20 are now caused to turn at the predetermined ratio back to the starting position.

Figure 19:
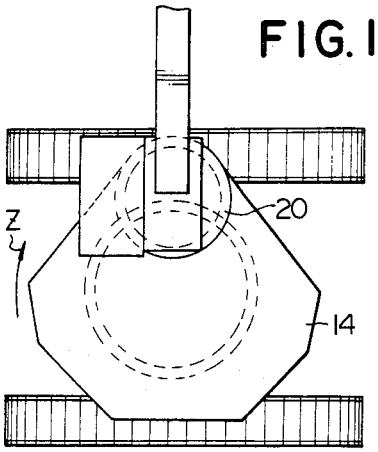
FIGS. 19 and 20 are plan views of the excavator of FIG. 17, showing angular positions of the turntable and the carriage moved by the hydraulic driving system illustrated in FIG. 18.

(2) Rotation of the turntable 14 only:

The solenoid-operated valve 141 remains inactivated and the solenoid-operated valve 142 is actuated to put the directional control valve 123 in the supply mode and the directional control valve 124 in the return mode. A portion of oil from the hydraulic pump 115 is delivered through relief valves 139, 140 to the directional control valves 123, 124. The directional control valve 123 is in the same condition as described above, but the directional control valve 124 is shifted by the actuated solenoid-operated valve 142 to form a return flow path therein so that no oil will be directed to the hydraulic motor 41. When the directional control valve 117 is shifted from the "neutral" position to the "normal" position at this time, oil under pressure from the hydraulic pump 115 flows through the directional control valve 117, the restriction 119, the directional control valve 123, and the check valve 130 to the hydraulic motor 18, from which oil passes through the automatic directional control valve 127, the directional control valve 123, the directional control valve 124, the restriction 120, and the directional control valve 117 back into the tank 116. Therefore, the hydraulic motor 18 only is actuated to turn the turntable 14. The carriage 20 on the turntable 14 and the excavating mechanism 48 on the carriage 20 are now located on one side of the chassis 10 as shown in FIG. 19. The excavating mechanism 48 can now be moved up and down to effect digging operation in a position laterally of the chassis 10.

Figure 20:
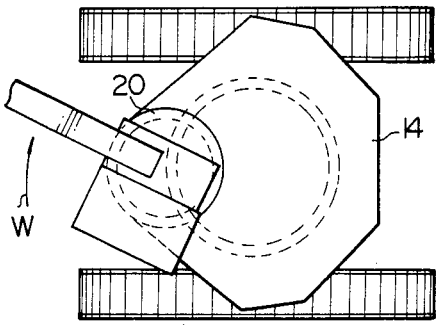

(3) Rotation of the carriage 20 only:

The solenoid-operated valve 142 remains inactivated and the solenoid-operated valve 141 is actuated to put the directional control valve 124 in the supply mode and the directional control valve 123 in the return mode. A portion of oil from the hydraulic pump 115 is delivered through the relief valves 139, 140 to the directional control valves 123, 124. The directional control valve 124 is kept in the position shown in FIG. 18, but the directional control valve 123 is shifted by the actuated solenoid-operated valve 141 to form a return flow path therein so that no oil will be directed to the hydraulic motor 18. When the directional control valve 117 is shifted from the "neutral" position to the "normal" position at this time, oil under pressure from the hydraulic pump 115 flows through the directional control valve 117, the restriction 119, the directional control valve 123, the directional control valve 124, and the check valve 132 to the hydraulic motor 41, from which oil passes through the automatic directional control valve 128, the directional control valve 124, the restriction 120, and the directional control valve 117 back into the tank 116. Therefore, the hydraulic motor 41 only is actuated to turn the carriage 20. The excavating mechanism 48 on the carriage 20 is now turned with respect to the turntable 14. Since the turntable 14 remains at rest, the excavating mechanism 48 is angularly moved through the angular interval through which the carriage 20 is turned with respect to the turntable 14, as shown in FIG. 20. In the position of FIG. 20, only the carriage 20 is angularly moved to enable the excavating mechanism 48 to swing in a sectorial zone in front of the chassis 10, so that the road can be dug by the excavating mechanism in such a sectoral zone.

With the hydraulic driving system illustrated in FIG. 18, the turntable and the carriage can be rotated synchronously or independently through the control of oil flow paths.

Figure 22:
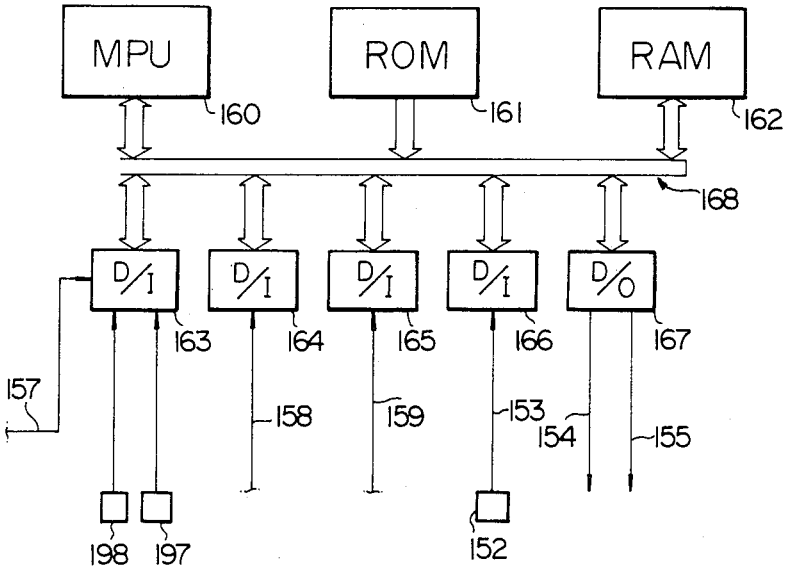
FIG. 22 is a block diagram of an electric control system for controlling the hydraulic driving system shown in FIG. 21.
Figure 21:
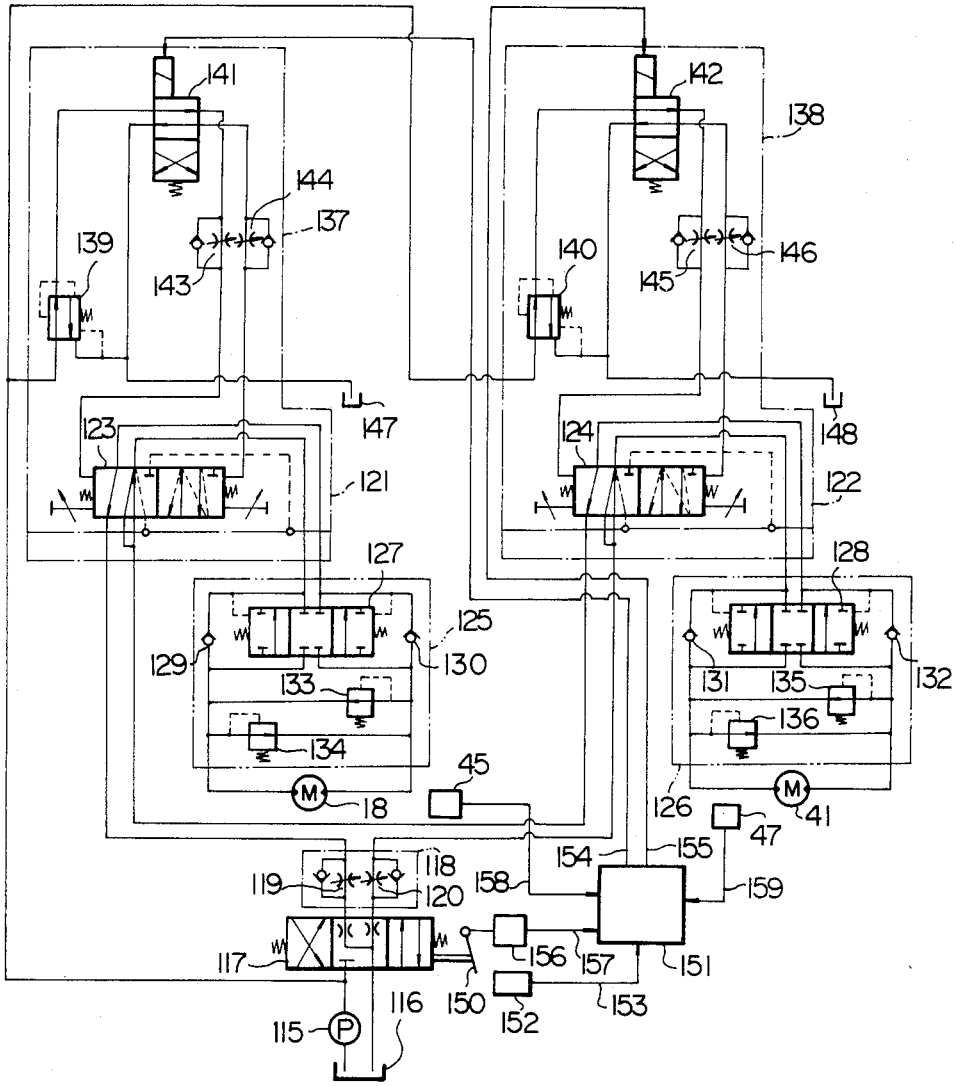
FIG. 21 is a circuit diagram of a hydraulic driving system according to a still further embodiment of the present invention.
Figure 23:
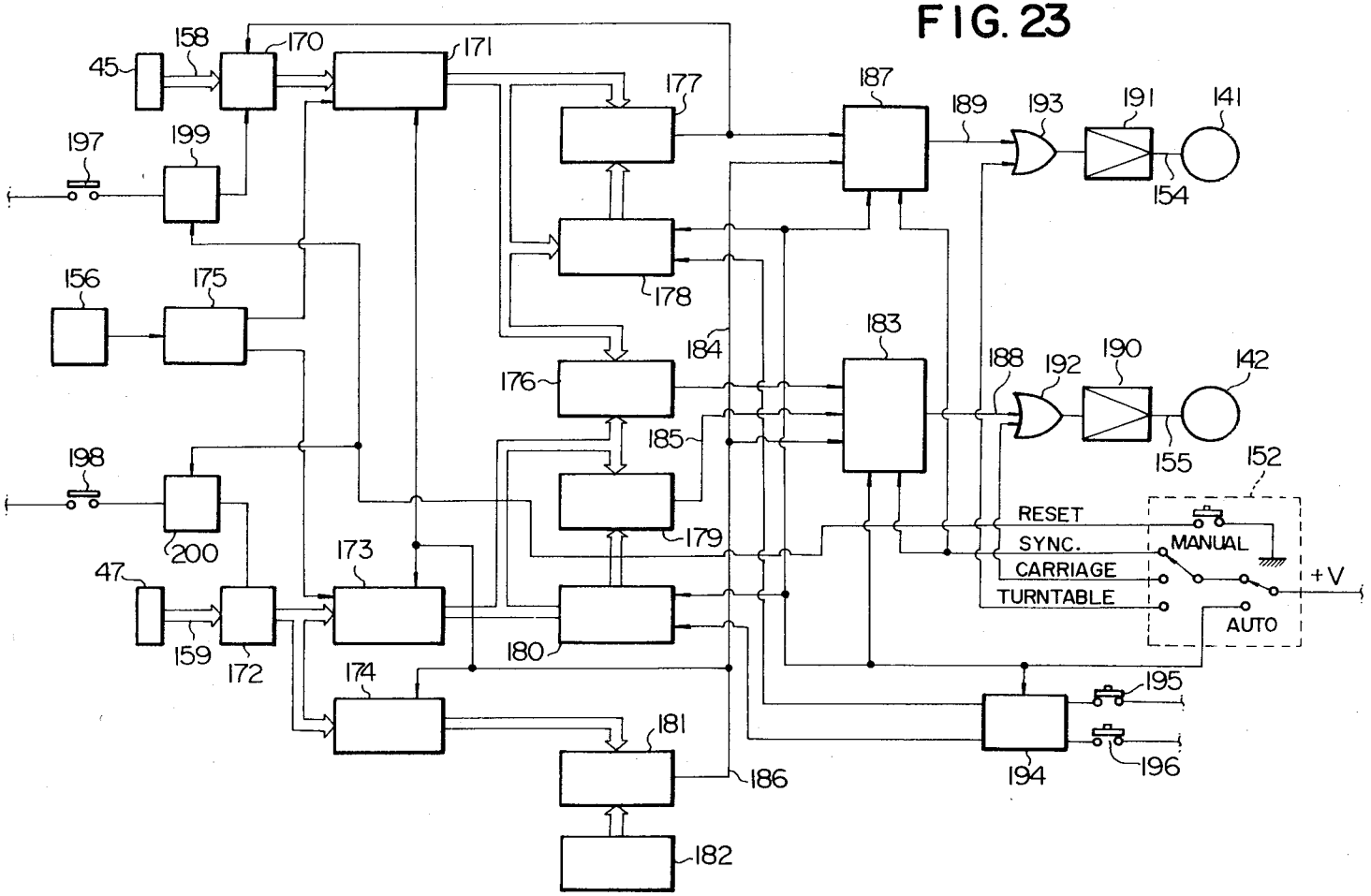
FIG. 23 is a block diagram showing the electric control system of FIG. 22 in greater detail.

FIGS. 21 through 23 show a hydraulic control system and an electric control system according to a still further embodiment of the present invention. An excavator controlled by the hydraulic control system and the electric control system illustrated in FIGS. 21 through 23 is of the same construction as shown in FIGS. 1 through 7.

The hydraulic control system of FIG. 21 is similar to that shown in FIG. 18, but is controlled by the electric control system. The directional control valve 117 can be operated by an actuator lever 150. The electric control system includes an electric control unit 151 supplied with signals 158, 159 fed from the angle detectors 45, 47 and indicative of angular displacements of the turntable 14 and the carriage 20, respectively. The electric control unit 151 initiates operation of the hydraulic motors 18, 41 in response to a command 153 fed from a control switch 152 operated upon by the operator. The electric control unit 151 is responsive to the signals 158, 159 from the angle detectors 45, 47 and a directional signal 157 from a signal generator 156 actuated by the actuator lever 150 for issuing control signals 154, 155 to switchingly control the solenoid-operated valves 141, 142 for rotating the turntable 14 and the carriage 20.

FIG. 22 is a block diagram of the electric control unit 151. The electric control unit 151 includes a microprocessor unit 160, a read-only memory 161 storing a program for operating the microprocessor unit 160 in a predetermined sequence, a random-access memory 162 for storing prescribed contstants and externally supplied data, digital input ports 163 through 167 receptive of external digital signals, and a bus assembly 168 interconnecting the microprocessor unit 160, the read-only memory 161, the random-access memory 162, and the digital input ports 163 through 167.

The electric control unit 151 is illustrated in greater detail in FIG. 23. The detected signal 158 from the angle detector 45 is applied through a gate 170 to an up-down counter 171. The detected signal 159 from the angle detector 47 is applied through a gate 172 to an up-down counter 173 and a counter 174. The directional signal 157 from the signal generator 156 is shaped by a waveform shaper 175 and then fed to both the up-down counters 171, 173, which issue count outputs to a comparator 176.

The count output from the up-down counter 171 is also fed to a comparator 177 and a latch memory 178. The count output from the up-down counter 173 is also fed to a comparator 179 and a latch memory 110. The comparator 177 is also supplied with an output signal from the latch memory 178 when there is an output command. Likewise, the comparator 179 is also supplied with an output signal from the latch memory 180 when there is an output command.

The counter 174 issues a count output to a comparator 181 supplied with a reference angle signal set by the digital switch 182. When the count output from the counter 174 coincides with the reference angle signal from the digital switch 182, the comparator 181 issues a coincidence or stop signal 186 which resets the counters 171, 173, 174.

When the inputs to the comparator 176 coincide with each other, the comparator 176 issues a coincidence signal 184 to a stop signal selector 183 which is also supplied with coincidence signals 185, 186 from the comparators 179, 181. The comparator 177 issues a coincidence signal to the gate 170 and a stop signal selector 187 which is also supplied with the coincidence signal 186 from the comparator 181.

The stop signal selectors 183, 187 issue output signals 188, 189 through OR gates 192, 193, respectively, to drivers 190, 191 which issue the signals 155, 154 for driving the solenoid-operated valves 142, 141. The drivers 190, 191 serve to actuate the solenoid-operated valves 142, 141 when the output signals 188, 189 are of logic level "0".

The control switch 152 is of the illustrated construction capable of switching between manual and automatic modes of operation, and of selecting one of synchronized turntable and carriage operation, carriage operation, and turntable operation when the manual mode is selected.

When the automatic mode is selected on the control switch 152, the signals 184, 185 from the comparators 176, 179 and the signal from the comparator 177 are selected by the selectors 183, 187. At this time, when preset switches 195 and/or 196 connected to a gate 194 are actuated, the latch memories 178 and/or 180 store the count outputs from the counters 171, 173. Thereafter, the count stored in the latch memory 178 and the count from the counter 171 are compared by the comparator 177, and the count stored in the latch memory 180 and the count from the counter 173 are compared by the comparator 179. The turntable 14 and the carriage 20 are automatically stopped between certain positions between the stored counts.

When the synchronized operation, the carriage operation, or the turntable operation is selected on the control switch 152, the automatic mode is changed to the manual mode. When the turntable operation is selected on the control switch 152, a signal from the control switch 152 is supplied through the OR gate 193 to the driver 191 which is energized to turn off the solenoid-operated valve 141 and turn on the solenoid-operated valve 142. When the carriage operation is selected on the control switch 152, a signal from the control switch 152 is fed through the OR gate 192 to the driver 190 which is energized to turn off the solenoid-operated valve 142 and then turn on the solenoid-operated valve 141. When the synchronized operation is selected on the control switch 152, the output signal 184 from the comparator 176 is selected by the selector 183, and the latch memories 178, 180 are de-energized. At this time, the counts from the counters 171, 173 are compared by the comparator 176. When the compared counts are different from each other, the solenoid-operated valves 141, 142 are turned off. When the compared counts coincide with each other, the solenoid-operated valves 141, 142 are turned on and off, respectively.

When the turntable 14 and the carriage 20 are turned through certain angles, limit switches 197, 198 are actuated to issue signals through waveform shapers 199, 200, respectively, to the gates 170, 172. The gates 170, 172 are enabled by the signals from the waveform shapers 199, 200 to allow the signals 158, 159 from the angle detectors 45, 47 to be supplied to the counters 171, 173, respectively.

Operation of the hydraulic driving system and the electric control system shown in FIGS. 21 through 23 will be described.

The turntable 14 and the carriage 20 will be angularly moved by the hydraulic motors 18, 41 in the following modes:

(1) Synchronized operation of the turntable 14 and the carriage 20 with the synchronized operation mode selected on the control switch 152:

The selectors 183, 187 select the output signals from the comparators 176, 177 and deliver these signals to the drivers 190, 191. Since the comparators 176, 177 issue non-coincidence signals, the solenoid-operated valves 142, 141 are turned off. With the solenoid-operated valves 141, 142 inactivated, they put the directional control valves 123, 124 in the supply mode.

Then, the hydraulic driving system shown in FIG. 21 operates in the same manner as that in which the hydraulic driving system of FIG. 18 rotates the turntable 14 and the carriage 20 simultaneously as described above in the synchronous mode of operation thereof.

Figure 10C:
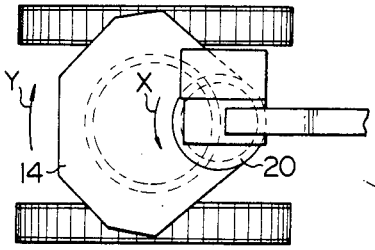

Therefore, the turntable 14 and the carriage 20 can be relatively angularly moved back and forth as shown in FIGS. 10A through 10C.

When the directional control valve 117 is shifted to the "normal" position, the directional signal 157 indicative of up counting or down counting is supplied through the waveform shaper 175 to the counters 171, 173 to enable the latter to function as up or down counters. When the hydraulic motors 18, 41 are then actuated, the angle detectors 45, 47 are operated to supply the detected signals 158, 159 to the counters 171, 173, respectively. The counts from the counters 171, 173 are compared by the comparator 176. When the compared counts coincide with each other, the solenoid-operated valve 142 is actuated with the solenoid-operated valve 141 remaining inactivated at this time. When the compared counts differ from each other, the solenoid-operated valves 141, 142 are inactivated. Therefore, while the directional control valve 117 is in the "normal" position, the turntable 14 continues to rotate. When the compared counts disagree, the solenoid-operated valve 142 is inactivated to rotate the carriage 20. When the compared counts coincide, the solenoid-operated valve 142 is actuated to prevent the rotation of the carriage 20.

(2) Rotation of the turntable 14 only with the turntable operation mode selected on the control switch 152:

When the turntable operation mode is selected on the control switch 152, a signal is supplied therefrom through the OR gate 193 to the driver 191 to inactivate the solenoid-operated valve 141. At this time, the solenoid-operated valve 142 remains actuated. Therefore, the directional control valve 123 is in the supply mode and the directional control valve 124 is in the return mode.

Then, the hydraulic driving system shown in FIG. 21 operates in the same manner as that in which the hydraulic driving system of FIG. 18 rotates the turntable 14 only as described above in the turntable operation mode.

(3) Rotation of the carriage 20 only with the carriage operation mode selected on the control switch 152:

When the carriage operation mode is selected on the control switch 152, a signal is supplied therefrom through the OR gate 192 to the driver 190 to inactivate the solenoid-operated valve 142. At this time, the solenoid-operated valve 141 remains actuated. Therefore, the directional control valve 124 is in the supply mode and the directional control valve 123 is in the return mode.

Then, the hydraulic driving system shown in FIG. 21 operates in the same manner as that in which the hydraulic driving system of FIG. 18 rotates the carriage 20 only as described above in the carriage operation mode.

(4) Automatic operation with the automatic mode selected on the control switch 152:

When the automatic mode is selected on the control switch 152, the latch memories 178, 180 are ready for operation, and the output signal from the comparator 171 is supplied through the selector 187 to the driver 191. The output signals from the comparators 176, 179 are supplied through the selector 183 to the driver 190. Therefore, the solenoid-operated valves 141, 142 are inactivated.

The switches 195, 196 are depressed to store the output signals from the counters 171, 173 as indicating initial positions in the latch memories 178, 180, respectively. Then, the directional control valve 117 is shifted to rotate the turntable 14 and the carriage 20. At this time, the counts from the counters 171, 173 are compared by the comparator 176 for synchronized operation of the turntable 14 and the carriage 20 in the same manner as that described above in (1) with respect to FIG. 21. When the turntable 14 has reached a predetermined position, the switch 195 is depressed to store the count from the counter 171 as indicating positional information as to the turntable 14 in the latch memory 178, whereupon the turntable 14 is stopped. Since there is no coincidence signal from the comparator 179, though the comparator 176 issues a coincidence signal, the solenoid-operated valve 142 is rendered inoperative to keep the carriage 20 in rotation. When the carriage 20 has reached a predetermined position, the switch 196 is depressed to store the count from the counter 173 as indicating positional information as to the carriage 20 in the latch memory 180. Now, the comparator 179 issues a coincidence signal to actuate the solenoid-operated valve 142 for thereby stopping the carriage 20. Subsequently, the turntable 14 and the carriage 20 can be turned in synchronism repeatedly between prescribed two angularly displaced points simply by operating the directional control valve 117.

With the arrangement shown in FIGS. 21 through 23, the turntable 14 and the carriage 20 can be operated synchronously and automatically in an accurate fashion. The circuit shown in FIG. 23 can be implemented by a microcomputer. Although the circuit of FIG. 23 is shown and described as of a digital construction, it may also be arranged as an analog arrangement. The electric control unit shown in FIGS. 22 and 23 allows the hydraulic driving system of FIG. 21 to control the turntable 14 and the carriage 20 to be rotated in reliable and accurate synchronism.

Although certain preferred embodiments have been shown and described, it should be understood that many changes and modifications may be made therein without departing from the scope of the appended claims.

What is claimed is:

1. An earth-working machine comprising:

a mobile chassis;

a first gear fixedly mounted on said mobile chassis;

a turntable coaxially rotatably mounted on said first gear;

a carriage rotatably mounted on said turntable in eccentric relation thereto and having a second gear;

an earth-working mechanism mounted on said carriage;

a first hydraulic motor mounted on said turntable and having a first pinion held in driving mesh with said first gear for rotating said turntable about its own axis;

a second hydraulic motor mounted on said turntable and having a second pinion held in driving mesh with said second gear for rotating said carriage about its own axis;

a first angle detector provided between said mobile chassis and said turntable, and composed of first reference angle positioning means fixed to said mobile chassis and disposed in coaxial relation to a rotating center of said turntable and a first relative angle positioning means fixed to said turntable and disposed adjacent to said first reference angle positioning means in coaxial relation to a rotating center of said turntable for detecting a relative angle of rotation of said turntable with respect to said chassis;

a second angle detector provided between said turntable and said carriage, and composed of second reference angle positioning means fixed to said turntable and disposed in coaxial relation to a rotating center of said carriage and second relative angle positioning means fixed to said carriage and disposed adjacent to said second reference angle positioning means in coaxial relation to a rotating center of said carriage for detecting a relative angle of said carriage with respect to said turntable;

an electric control system responsive to signals from said first and second angle detectors for controlling said first and second hydraulic motors to rotate said turntable and said carriage at a prescribed angle displacement ratio; and wherein said first and second reference angle positioning means comprise magnetic disks having magnetic polarities arranged at equal intervals around peripheral edges thereof; and said first and second relative angle positioning means comprise magnetic pick-ups disposed adjacent to said magnetic disks and rotatable around peripheral edges of said magnetic disks.

2. An earth-working machine according to claim 1, wherein said first and second angle detectors magnetically detect said relative angles.

3. An earth working machine comprising:

a mobile chassis;

a first gear fixedly mounted on said mobile chassis;

a turntable coaxially rotatably mounting on said first gear;

a carriage rotatably mounted on said turntable in eccentric relation thereto and having a second gear;

an earth-working mechanism mounted on said carriage;

a first hydraulic motor mounted on said turntable and having a first pinion held in driving mesh with said first gear for rotating said turntable about its own axis;

a second hydraulic motor mounted on said turntable and having a second pinion held in driving mesh with said second gear for rotating said carriage about its own axis;

a first angle detector provided between said mobile chassis and said turntable, and composed of first reference angle positioning means fixed to said mobile chassis and disposed in coaxial relation to a rotating center of said turntable and a first relative angle positioning means fixed to said turntable and disposed adjacent to said first reference angle positioning means in coaxial relation to a rotating center of said turntable for detecting a relative angle of rotation of said turntable with respect to said chassis;

a second angle detector provided between said turntable and said carriage, and composed of second reference angle positioning means fixed to said turntable and disposed in coaxial relation to a rotating center of said carriage and second relative angle positioning means fixed to said carriage and disposed adajacent to said second reference angle positioning means in coaxial relation to a rotating center of said carriage for detecting a relative angle of said carraige with respect to said turntable; and an electric control system responsive to signals from said first and second angle detectors for controlling said first and second hydraulic motors to rotate said turntable and said carriage at a prescribed angle displacement ratio, said electric control system comprising a pair of first and second ganged switches for issuing signals, a pair of first and second drivers for actuating first and second solenoid-operated valves, respectively, said first driver being connected to said first switch, a pair of first pulse generators responsive to the signals from said first and second angle detectors, respectively, for genenrating pulse signals, a frequency divider connected to said first pulse generator, a first gate for passing a signal from said frequency divider while the signal from said first switch is being applied to said first gate, a second gate for passing a signal; from said second pulse generator while the signal from said second switch is being applied to said second gate, a pair of first and second counters for counting signals from said first and second gates, respepctively, control means for comparing count signals from said first and second counters, and energizing said second driver when said count signals coincide with each other and de-energizing said second driver when said counter signals differ from each other.

4. An earth-working amchine according to claim 3, wherein said control means comprises a comparator and conincidence circuit for comparing the counter signals from said first and second counters and an RS flip-flop connected between said comparator and conincidence circuit and said second driver, further including a one-shot multivibrator connected to said RS flip-flop for clearing said first and second counters.

5. An earth-working machine comprising:

a mobile chassis having an axis;

a turntable mounted centrally on said mobile chassis and rotatable 360 degrees on said mobile chassis, an axis of said turntable being in coaxial relation to an axis of said mobile chassis;

a carraige mounted on said turntable and rotated 360 degrees on said turntable, an axis of said carriage being in horizontally eccentric relation to said axis of said turntable;

an earth-working mechanism mounted on said carriage;

a first hydraulic means mounted on said turntable for rotating said turntable about its own axis;

a second hydraulic means mounted on said turntable for rotating said carriage about its own axis independently of said first hydraulic means;

hydraulic control means for controlling said first and second hydraulic means;

a first angle detector provided between said mobile chassis and said turntable for detecting an angle of rotation of said turntable with respect to said chassis;

a second angle detector provided between said turntable and said carriage for detecting an angle of rotation of said turntable with respect to said carriage;

an electric control system responsive to signals from said first and second angle detectors for controlling said hydraulic control means to rotate said turntable and said carraige to a selected angular displacement therebetween in response to said signals; and wherein said first and second reference angle positioning means comprise magnetic disks having magnetic polarities arranged at equal intervals around peripheral edges thereof, and said first and second relative angle positioning means comprise magnetic pick-ups disposed adajacent to said magnetic disks and rotatable around peripheral edges of said magnetic disks.

6. An earth-working machine according to claim 5, wherein said mobile chassis has a first gear fixedly mounted thereon for engaging with a first pinion mounted on said first hydraulic means and held in driving mesh with said first gear to rotate said turntable about its own axis.

7. An earth-working machine according to claim 5, wherein said carriage has a second gear for engaging with a second pinion mounted on said second hydraulic means and held in driving mesh with said second gear to rotate said carraige about its own axis.

8. An earth-working machine according to claim 5, wherein said first angle detector is composed of first reference angle positioning means fixed to said mobile chassis and disposed in coaxial relation to a rotating center of said turntable and a first relative angle positioning means fixed to said turntable and disposed adjacent to said first reference angle positioning means in coaxial relation to a rotating center of said turntable for detecting a relative angle of rotation of said turntable with respect to said chassis.

9. An earth-working machine according to claim 5, wherein said second angle detector is composed of second reference angle positioining means fixed to said turntable and disposed in coaxial relation to a rotating center of said carriage and second relative angle positioning means fixed to said carriage and disposed adjacent to said second reference angle positioning means in coaxial relation to a rotating center of said carriage for detecting a relative angle of said carriage with respect to said turntable.

10. An earth-working machine according to claim 5, wherein said first and second angle detectors magnetically detect said relative angles.

11. An earth working machine comprising:

a mobile chassis having an axis;

a turntable mounted centrally on said mobile chassis and rotatable 360 degrees on said mobile chassis, an axis of said turntable being in coaxial relation to an axis of said mobile chassis;

a carriage mounted on said turntable and rotated 360 degrees on said turntable, an axis of said carriage being in horizontally eccentric relation to said axis of said turntable;

an earth-working mechanism mounted on said carriage;

a first hydraulic means mounted on said turntable for rotating said turntable about its own axis;

a second hydraulic means mounted on said turntable for rotating said carriage about its own axis independently of said first hydraulic means;

hydraulic control means for controlling said first and second hydraulic means;

a first angle detector provided between said mobile chassis and said turntable for detecting an angle of rotation of said turntable with respect to said chassis;

a second angle detector provided between said turntable and said carriage for detecting an angle of rotation of said turntable with respect to said carriage;

an electric control system responsive to signals from said first and second angle detectors for controlling said hydraulic control means to rotate said turntable and said carriage to a selected angular displacement therebetween in response to said signals, said electric control system comprising a pair of first and second ganged switches for issuing signals, a pair of first and second rivers for actuating first and second solenoid-operated valves, respectively, said first driver being connected to said first switch, a pair of first pulse generators responsive to the signals from said first and second angle detectors, respectively, for generating pulse siganls, a frequency divider connected to said first pulse generator, a first gate for passing a signal from said frequency divider while the signal from said first switch is being applied to said first gate, a second gate for passing a signal from said second pulse generator while the signal from said second switch is being applied to said second gate, a pair of first and second counters for counting signals from said first and second gates, respectively, control means for comparing count signals from said first and second counters, and energizing said second driver when said count signals coincide with each other and de-enerigizing said second driver when said counter signals differ from each other.

12. An earth-working machine according to claim 11, wherein said control means comprises a comparator and coincidence circuit for comparing the count signals from said first and second counters and an RS flip-flop connected between said comparator and coincidence circuit and said second driver, further including a one-shot multivibrator connected to said RS flip-flop for clearing said first and second counters.

* * * * *